US008789917B2

(12) United States Patent
Kubo et al.

(10) Patent No.: US 8,789,917 B2
(45) Date of Patent: Jul. 29, 2014

(54) LIQUID DROPLET JETTING APPARATUS

(75) Inventors: Tomoyuki Kubo, Nagoya (JP); Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 518 days.

(21) Appl. No.: 12/549,550

(22) Filed: Aug. 28, 2009

(65) Prior Publication Data

US 2010/0053257 A1 Mar. 4, 2010

(30) Foreign Application Priority Data

Aug. 28, 2008 (JP) ..... 2008-219286

(51) Int. Cl.
*B41J 2/165* (2006.01)

(52) U.S. Cl.
USPC ..... 347/30

(58) Field of Classification Search
None
See application file for complete search history.

(56) References Cited

U.S. PATENT DOCUMENTS

| | | | | |
|---|---|---|---|---|
| 4,494,124 | A * | 1/1985 | Piatt et al. | 347/89 |
| 5,398,053 | A | 3/1995 | Hirosawa et al. | |
| 6,481,824 | B1 * | 11/2002 | Hayakawa et al. | 347/24 |
| 6,827,417 | B2 * | 12/2004 | Seino | 347/19 |
| 6,846,062 | B2 * | 1/2005 | Harada et al. | 347/30 |
| 7,121,644 | B2 | 10/2006 | Ueda et al. | |
| 2005/0174382 | A1 * | 8/2005 | Yoshikawa et al. | 347/30 |
| 2009/0167809 | A1 * | 7/2009 | Kondo | 347/19 |

FOREIGN PATENT DOCUMENTS

| | | |
|---|---|---|
| JP | 2276647 | 11/1990 |
| JP | 7-132617 | 5/1995 |
| JP | 7-290721 | 11/1995 |
| JP | 11277773 | 10/1999 |
| JP | 2002-292904 | 10/2002 |
| JP | 2004-291486 | 10/2004 |
| JP | 2004-322612 | 11/2004 |
| JP | 2005-14368 | 1/2005 |

* cited by examiner

*Primary Examiner* — Alejandro Valencia
(74) *Attorney, Agent, or Firm* — Frommer Lawrence & Haug LLP

(57) ABSTRACT

A printer controls a suction pump such that a difference in a discharge amount of an ink and a flow speed of the ink discharged from each nozzle is small between a complete purge in which all ink supply portions connected to a second head communicate with an atmosphere, and a suction purge is performed simultaneously for the nozzles of all types of the second head, and a partial purge in which a communication of a part of the ink supply portions with the atmosphere is blocked by a dummy cartridge, and the suction purge is performed only for the nozzles corresponding to the ink supply portions of which the communication with the atmosphere is not blocked.

5 Claims, 16 Drawing Sheets

LIQUID DROPLET JETTING APPARATUS

CROSS-REFERENCE TO RELATED APPLICATION

The present application claims priority from Japanese Patent Application No. 2008-219286, filed on Aug. 28, 2008, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

A color ink-jet printer which carries out recording of an image by jetting droplets of inks of a plurality of colors on to a recording medium has hitherto been known as a liquid droplet jetting apparatus which jets liquid droplets from nozzles. In the ink-jet printer, due to an increase in a viscosity (hereinafter, also called as "thickening") of ink in the nozzle due to drying, and due to an entry of dust or an air bubble into an ink channel communicating with the nozzle, a jetting defect is susceptible to occur in the nozzle. Therefore, in a normal inkjet printer, it is possible to perform a so-called purge operation, in which the ink is discharged forcibly from the nozzle, and the thickened ink and the air bubble which cause the jetting defect are removed with the ink.

For instance, a conventional ink-jet printer disclosed in U.S. Pat. No. 7,121,644 (corresponding to Japanese Patent Application Laid-open No. 2005-14368) includes a carriage which is reciprocatable in a width direction of a paper which is a recording medium, four ink cartridges which store inks of four colors respectively, and which are attached to the carriage, and an ink-jet head which is attached to the carriage, and which has four nozzle rows jetting the inks of four colors. Moreover, the conventional ink-jet printer includes a purge unit which is provided at a predetermined purge position, and which carries out the purge operation. The purge unit includes four suction caps which cover liquid droplet jetting ports of the nozzles (four nozzle rows) of four colors by making a close contact with the ink-jet head when the ink-jet head has moved to the purge position, and a suction pump which is connected to the suction caps. The ink is discharged by sucking from the nozzles (suction purge) by generating a negative pressure inside the suction caps by the suction pump, in a state of the nozzles for four colors covered by the suction caps.

In such inkjet printer, for example, by attaching an ink supply port sealing cap instead of an ink cartridge of a specific color (for example, an ink cartridge which stores a color ink), ink supply port which supplies an ink of the specific color to the ink-jet head is blocked, and it is possible to perform printing of an image etc. by using only inks (such as black ink) other than the ink of that specific color.

In such conventional ink-jet printer, when one suction pump is connected to four suction caps covering the four nozzle rows corresponding to the inks of four colors respectively, only by operating one suction pump with the four nozzle rows covered by the suction caps respectively, it is possible to perform the suction purge at a time for all the nozzles. In other words, it is possible to perform the suction purge efficiently for all the nozzles at the same time.

Incidentally, in such conventional ink-jet printer, as it has been described above, for making an arrangement such that certain specific color is not used, sometimes the ink supply port sealing cap is attached to the carriage instead of the ink cartridge for the ink of that specific color. In this manner, in a state of the ink of the specific color not supplied to the ink-jet head, when the suction pump is operated after covering the nozzles by the suction cap in the same manner as described above, naturally, the ink is discharged from the nozzle which jets the ink of the specific color, and the suction purge is performed only for the nozzles which jet the inks of colors other than the specific color.

However, when the suction pump is operated, in a case, in which the suction purge is performed for all types of nozzles (hereinafter, also called as a "complete purge"), and in a case, in which ink channels communicating with a part of the nozzles are closed, and the suction purge is performed only for the rest of the nozzles (hereinafter, also called as a "partial purge"), the number of nozzles from which the ink is discharged practically differs. Therefore, when suction conditions (such as a suction speed and a suction amount are not changed, a flow speed and an amount of the ink discharged from each nozzle differ. Therefore, there is a possibility that the purge from a certain nozzle is insufficient, and the jetting defect cannot be eliminated, or there is a possibility that an excessive ink surpassing substantially an amount necessary for eliminating the jetting defect is discharged.

SUMMARY OF THE INVENTION

An object of the present invention is to provide a liquid droplet jetting apparatus in which it is possible to select the "complete purge" and the "partial purge", and furthermore, to realize both of an assured purge of each nozzle, and a prevention of a discharge of excessive liquid, even when any of the purge is selected.

According to a first aspect of the present invention, there is provided a liquid droplet jetting apparatus which jets liquid droplets of a plurality of types of liquids, including: a liquid droplet jetting head which includes a plurality of types of nozzles which jet the liquids respectively; a plurality of liquid supply sections which are connected to the liquid droplet jetting head and which supply the liquids to the nozzles in a state that the liquid supply sections are communicated with atmosphere; a purge mechanism including a suction cap which is attachable to the liquid droplet jetting head to cover the nozzles, and a suction mechanism which is communicated in common with the nozzles via the suction cap when the suction cap is attached, and which performs a suction purge of discharging the liquids from the nozzles with suction inside the suction cap by the suction mechanism; a blocking mechanism which blocks communication between the atmosphere and each of the liquid supply sections to perform the suction purge only for a part of nozzles among the nozzles; and a maintenance control section which controls the liquid droplet jetting head and the purge mechanism to perform a maintenance operation including the suction purge, and the maintenance control section controls the suction mechanism such that a difference in a discharge amount of the liquids and a flow speed of the liquids discharged from the nozzles respectively is small between a complete purge, in which all the liquid supply sections communicate with the atmosphere and the suction purge is performed simultaneously for the nozzles of all types, and a partial purge in which the communication of the part of the liquid supply sections with the atmosphere is blocked by the blocking mechanism and the suction purge is performed only for nozzles, among the plurality of types of nozzles, corresponding to liquid supply sections, each of which the communication with the atmosphere is not blocked.

When the communication, with the atmosphere, of all the plurality of liquid supply sections is maintained in a state that the nozzles of the plurality of types are covered by the suction cap, at the time of performing the suction purge by the purge mechanism, the liquids are discharged simultaneously from the nozzles of the plurality of types communicating with these liquid supply sections (complete purge). Whereas, when the communication, with the atmosphere, of some liquid supply sections out of the plurality of liquid supply sections is blocked by the blocking mechanism, at the time of the suction purge, the liquid is not discharged from the nozzles communicating with the liquid supply sections among the plurality of liquid supply sections (partial purge). In other words, it is possible to perform the complete purge with the suction mechanism in common for the nozzles of the plurality of types, and on the other hand, it is possible to perform the partial purge for a part of the nozzles by blocking the communication, with the atmosphere, of the specific liquid supply sections by the blocking mechanism.

However, the flow speed and the amount of discharge for each nozzle varies at the time of purge, since the number of nozzles from which the liquid is practically discharged is different between the complete purge, in which all the liquid supply sections communicate with the atmosphere, and the partial purge, in which communication of some of the liquid supply sections with the atmosphere is blocked. In other words, at the time of the partial purge, the flow speed or the amount of liquid discharged from a specific nozzle for which the purge is performed is excessively substantial, or inversely, at the time of the complete purge, the flow speed at each nozzle is excessively low, or the amount of discharge is insufficient, and due to this, there is a possibility that there is a nozzle for which the discharge of thickened liquid or an air bubble and impurities is insufficient. Therefore, in the present invention, the suction mechanism is controlled such that the difference in the discharge amount of the liquid and the flow speed of the liquid discharged from each nozzle becomes small between the complete purge and the partial purge. Accordingly, at the time of the complete purge, it is possible to perform a sufficient purge from any nozzle, and at the time of the partial purge, it is possible to prevent the excessive amount of liquid from being discharged from the nozzles for which the purge has been performed.

BRIEF DESCRIPTION OF THE DRAWINGS

FIG. 15A is a diagram showing a state of starting attachment of the ink cartridge, FIG. 15B is a diagram showing a state in which the attachment of the ink cartridge is completed (when communicating with the atmosphere), and FIG. 15C shows a state in which the attachment of the ink cartridge is completed (when the communication with the atmosphere is blocked)

DETAILED DESCRIPTION OF THE PREFERRED EMBODIMENTS

A first embodiment of the present invention will be described below.

Figure 1:
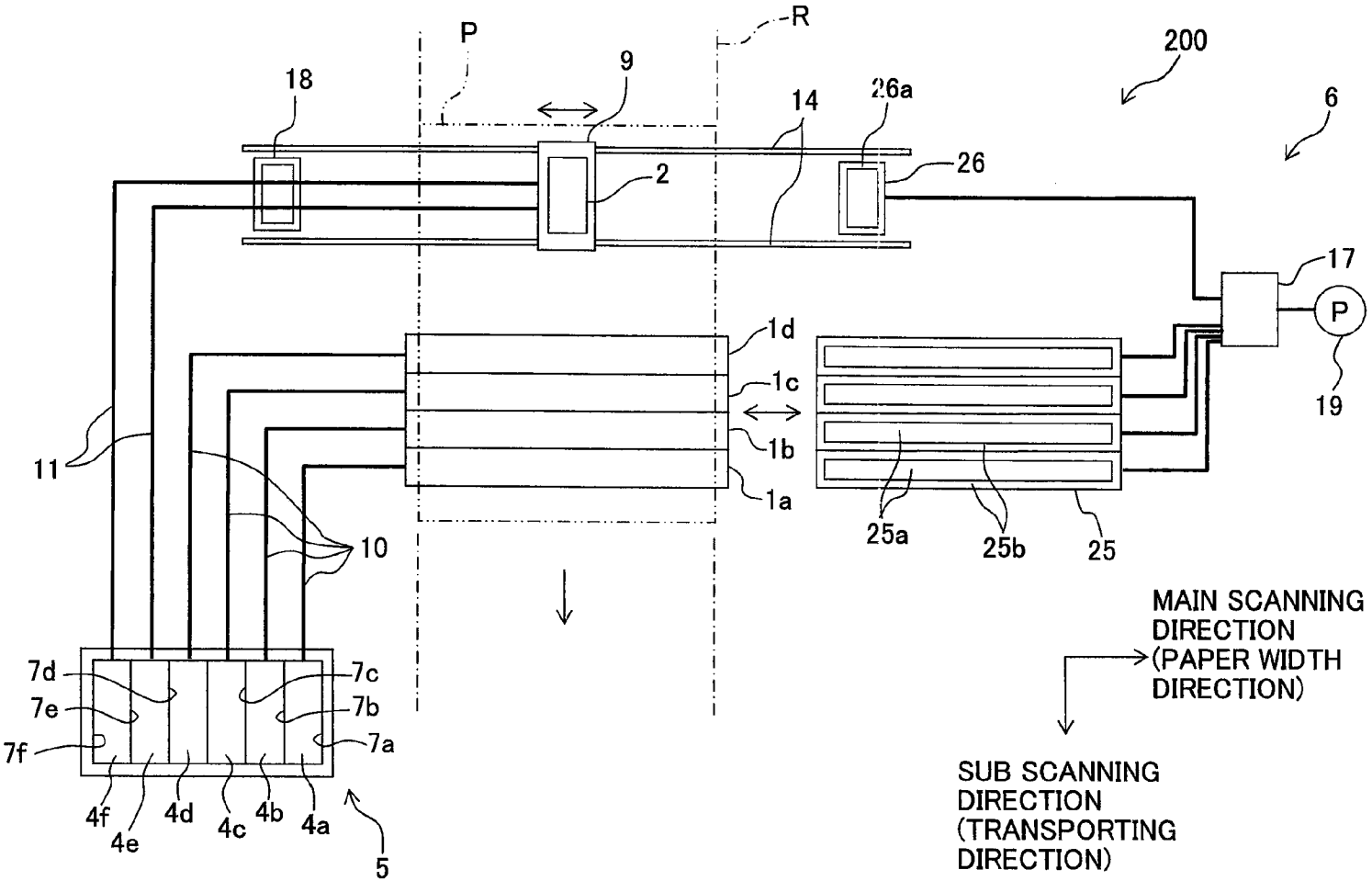
FIG. 1 is a schematic top view of an ink-jet printer according to a first embodiment.
Figure 14:
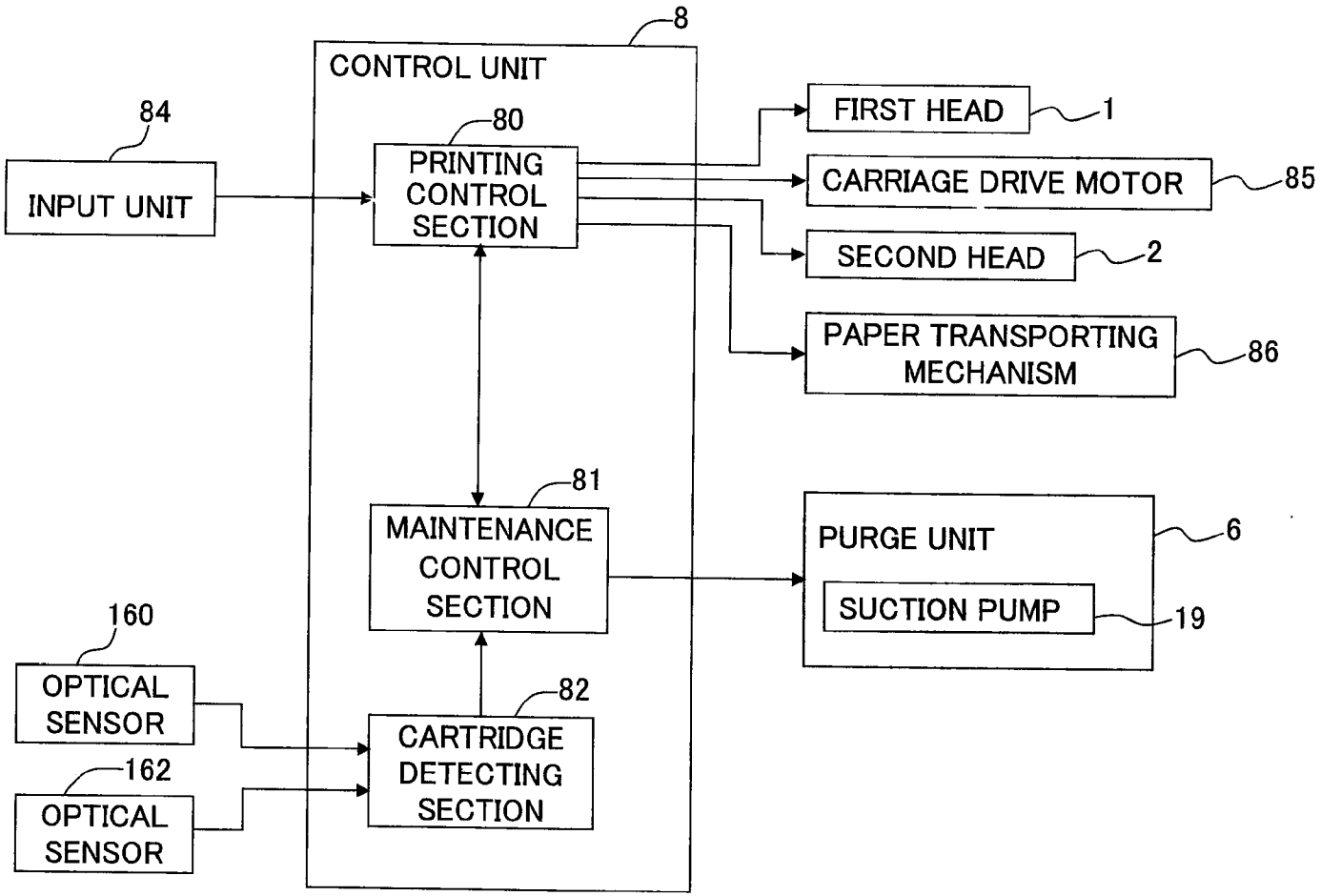
FIG. 14 is a block diagram showing schematically an electrical structure of the printer according to the first embodiment.

As shown in FIG. 1, an ink-jet printer 200 (hereinafter, called only as a "printer 200") of the first embodiment includes four first heads 1*a*, 1*b*, 1*c*, and 1*d* (hereinafter "first heads 1*a* to 1*d*" or "first head 1") which are fixed line heads, a second head 2 which is a serial head, a holder 5 on which, six ink cartridges 4*a*, 4*b*, 4*c*, 4*d*, 4*e*, and 4*f* (hereinafter, "ink cartridges 4*a* to 4*f*") which store inks of six types (six colors) respectively, a purge unit 6 (a purge mechanism) which carries out a purge of the first heads 1(1*a* to 1*d*) and the second head 2, and a control unit 8 which carries out an overall control of the printer 200 (refer to FIG. 14).

The printer 200 prints desired characters or image etc. on a printing paper P (object) by jetting droplets of inks on to the printing paper P from the first head 1 and the second head 2 while transporting the printing paper P along a paper transporting path R (shown by alternate long and short dashed lines in FIG. 1) by a paper transporting mechanism 8 (refer to FIG. 14) which includes a plurality of rollers and a motor which drives the rollers to rotate.

The four first heads 1*a* to 1*d* are connected to the four ink cartridges 4*a* to 4*d* which store basic inks (basic liquids) of four colors (namely, yellow, magenta, cyan, and black) having a high frequency of use, via tubes 10. Moreover, the four first heads 1*a* to 1*d* are arranged side-by-side in a transporting direction (secondary scanning direction).

Figure 2:
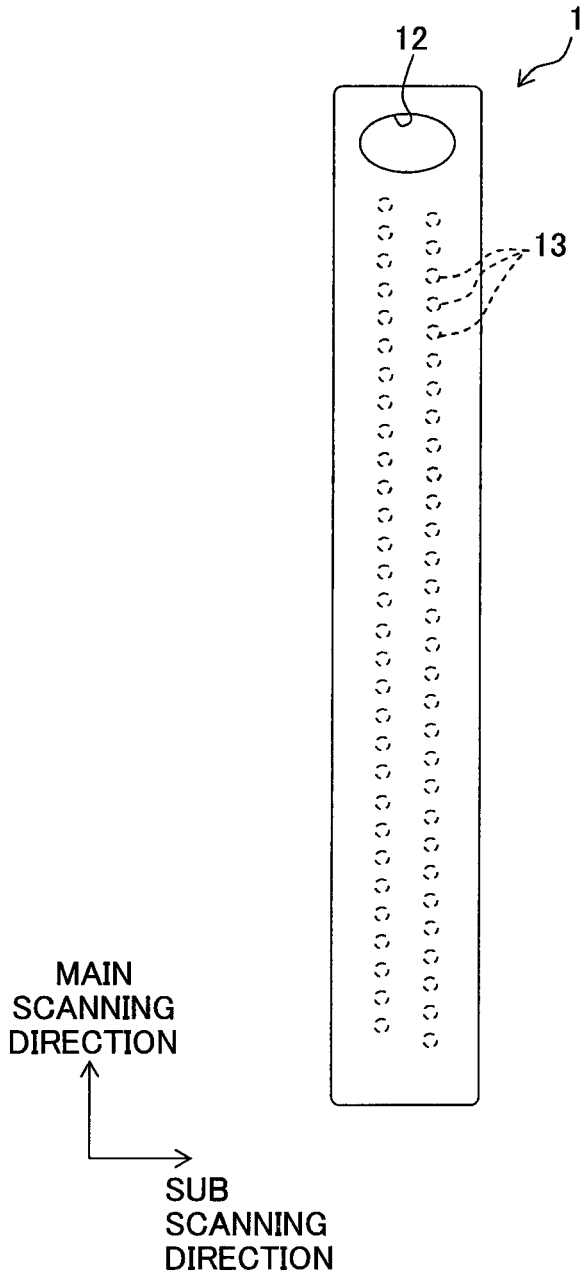
FIG. 2 is a top view of a first head.

As shown in FIG. 2, each first head 1 includes one ink supply port 12 formed in an upper surface thereof, which is connected to the tube 10 (refer to FIG. 1), and a plurality of nozzles 13 (basic-liquid jetting nozzles) arranged in two rows spread over an entire area of width of a paper, along a width direction of paper (main scanning direction: left-right direction in FIG. 1 and vertical direction in FIG. 2) orthogonal to the transporting direction of the printing paper P, on a lower surface (a surface on a reverse side of the paper in FIG. 2). The two rows of the nozzles 13 are arranged to be misaligned by half of a distance between the nozzle rows in the main scanning direction. Moreover, the large number of nozzles 13 communicate with the ink supply port 12 via an ink channel (omitted in the diagram) formed at an interior of the first head 1.

The four first heads 1*a* to 1*d* jet basic inks of four colors (namely, yellow, magenta, cyan, and black) from the corresponding nozzles 13, supplied from the four ink cartridges 4*a* to 4*d*, in a state of being positioned and fixed at a predetermined liquid droplet jetting position (position in FIG. 1).

As shown in FIG. 1, a carriage 9 which is movable in the width direction of paper (main scanning direction) along two guide shafts 14 is arranged at a position on an upstream side in the transporting direction than the four first heads 1*a* to 1*d*, and the second head 2 of serial type is attached to the carriage 9. Moreover, the second head 2 is connected by tubes 11 to the two ink cartridges 4*e* and 4*f* which store inks (special liquids) of two colors (namely, light cyan and light magenta) having a frequency of use lower than the frequency of use of the basic inks of four colors.

Figure 3:
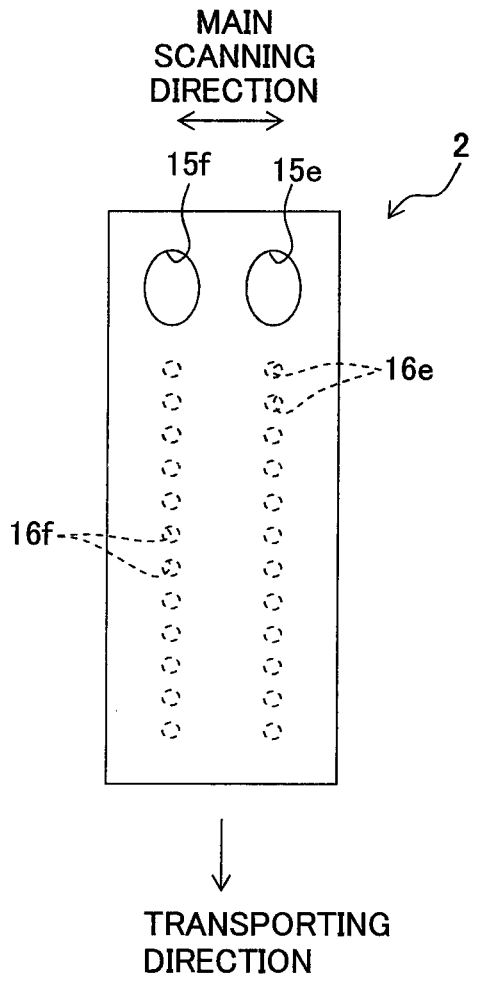
FIG. 3 is a top view of a second head.

As shown in FIG. 3, the second head 2 has two ink supply ports 15 (15*e* and 15*f*) which are formed in an upper surface thereof, and to which the two tubes 11 are connected respectively, and a plurality (two types) of nozzles 16 (16*e* and 16*f*) arranged in two rows along the transporting direction in the lower surface. The two ink supply ports 15 correspond to the two rows of nozzles 16 respectively, and one ink supply port 15 and the nozzle row (the plurality of nozzles 16 belonging to the nozzle row) corresponding to that ink supply port 15 communicate via an ink channel (omitted in the diagram) formed at an interior of the second head 2. Consequently, the ink of light cyan color stored in the ink cartridge 4*e* is supplied to the plurality of nozzles 16*e* forming one of the nozzle rows, via the tube 11 and an ink supply port 15*e*, and the ink of light magenta color stored in the ink cartridge 4*f*, similarly, is supplied to the plurality of nozzles 16*f* forming the other nozzle row, via the tube 11 and an ink supply port 15*f*.

When the carriage 9 is driven in the width direction of paper (main scanning direction) by a carriage drive motor 85 (refer to FIG. 14), the second head 2, while reciprocating integrally with the carriage 9 in the width direction of paper, jets the inks of two colors (namely, light cyan and light magenta) from the two nozzle rows toward the printing paper P which is transported on the paper transporting path R along the transporting direction.

As it has been described above, in a case of handling the basic inks (of yellow, magenta, cyan, and black colors) having a high frequency of use, and special inks (of light cyan color and light magenta color) having a low frequency of use, and further, in a case in which two heads namely the line head (the first head 1) and the serial head (the second head 2) are provided, it is not restricted particularly as to from which type of head (the serial head and the line head) the basic inks and the special inks are to be jetted. However, since the line head normally includes a large number of nozzles, and it is possible to jet a large number of liquid droplets in a short time as compared to the number of liquid droplets jetted by the serial head, it is preferable to jet the basic inks having the high frequency of use, from the line head. Moreover, in a case of jetting the special ink from the line head, it is necessary to provide a large number of nozzles for the special ink which is not used so frequently, and it is disadvantageous from a point of view of a manufacturing cost. In view of this, in the printer 200 of the first embodiment, the basic inks are jetted from the first head 1 which is a line head, and the special inks are jetted from the second head 2 which is a serial head.

Next, the ink cartridges 4*a* to 4*f* and the holder 5 to which the ink cartridges 4*a* to 4*f* are attached will be described in detail. As shown in FIG. 1, the holder 5 is provided with six cartridge attachment portions 7*a*, 7*b*, 7*c*, 7*d*, 7*e*, and 7*f* (hereinafter, "cartridge attachment portions 7*a* to 7*f*"), and the six ink cartridges 4*a* to 4*f* which store the inks of six colors (namely, yellow, magenta, cyan, black, light cyan, and light magenta) are detachably attached to the six cartridge attachment portions 7*a* to 7*f*. Moreover, the ink cartridge 4, one cartridge attachment portion 7 to which the ink cartridge 4 is attached, and the tube 10 (11) which connects the cartridge attachment portion 7 and the head (the first head 1 or the second head 2) form one ink supply portion which supply an ink of one type to the head.

Firstly, a concrete structure of the ink cartridge 4 which is an ink supply source will be described below. Since all the six ink cartridges 4*a* to 4*f* which store the inks of six colors have a similar structure, one of the six ink cartridges 4*a* to 4*f* will be described below.

Figure 4:
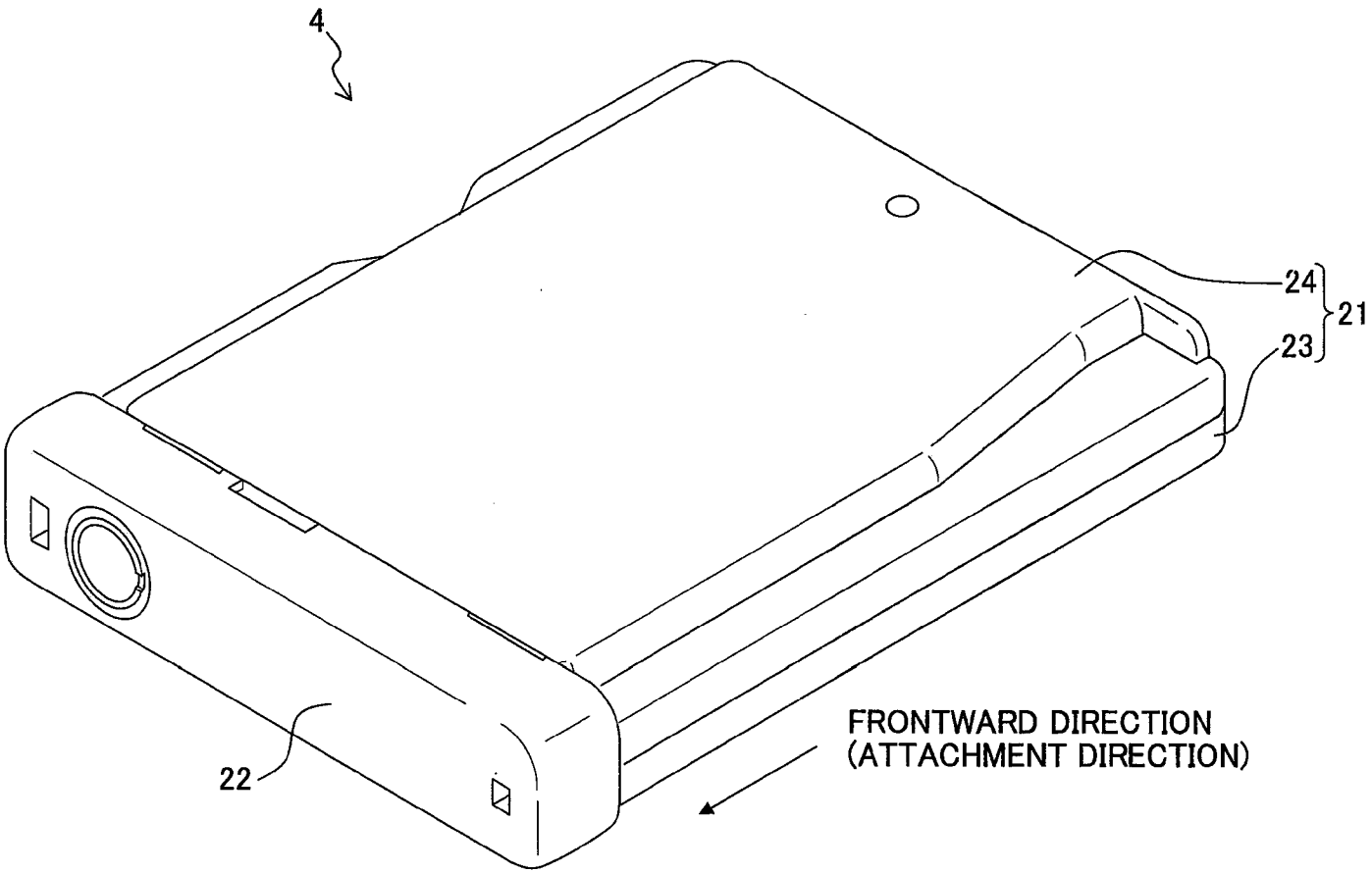
FIG. 4 is an external perspective view of an ink cartridge.

As shown in FIG. 4, the ink cartridge 4 is a substantial hexahedron (rectangular parallelepiped). Furthermore, out of the six surfaces of the hexahedron, two rectangular surfaces having the maximum area are facing mutually, and these two surfaces are connected by the other four surfaces. The ink cartridge 4, in a posture of the two rectangular surfaces becoming vertical surfaces, is attached to the cartridge attachment portion 7 of the holder 5 along a longitudinal direction of the rectangular surface. In the following description of the ink cartridge 4, the longitudinal direction of the rectangular surface which is the attachment direction of the ink cartridge 4 is defined as a frontward and rearward direction, and a width direction of the rectangular surface is defined as a vertical (upward and downward) direction. Moreover, a direction orthogonal to the rectangular surface is defined as a width direction of the ink cartridge 4.

Figure 5:
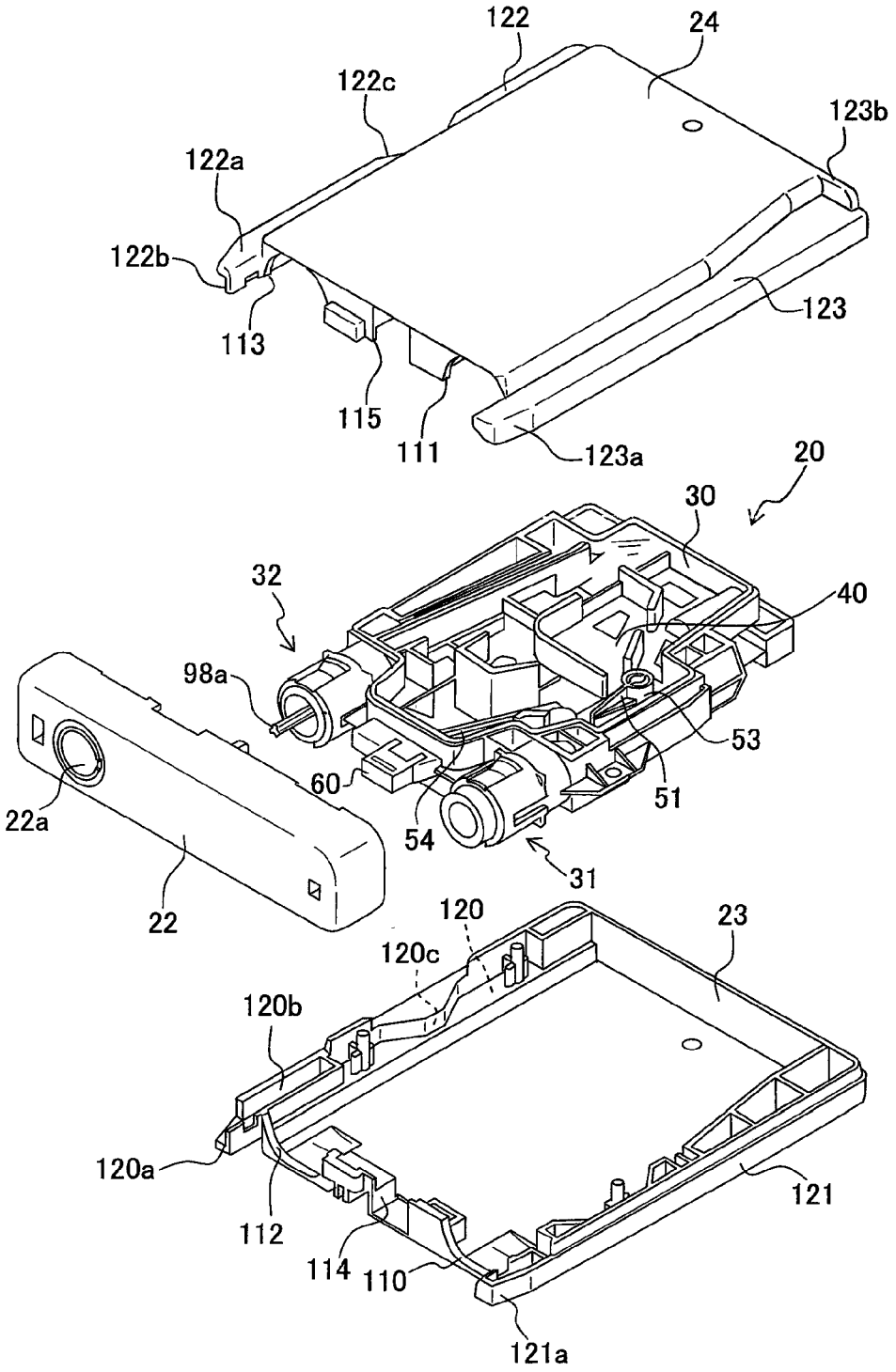
FIG. 5 is an exploded perspective view of the ink cartridge.

As shown in FIG. 4 and FIG. 5, the ink cartridge 4 includes a cartridge main body 20 which stores an ink, an external case 21 which covers substantially the whole of the cartridge main body 20, and a protector 22 which is to be attached to a front-end portion of the external case 21. The cartridge main body 20, the external case 21, and the protector 22 are made of a synthetic resin material such as nylon and polyethylene, or polypropylene.

Firstly, the cartridge main body 20 will be described below. As shown in FIG. 5, the cartridge main body 20 includes an ink storage body 30 having an ink storage chamber 40 which stores an ink at an interior, an ink deriving portion 31 which is provided at a lower portion of a front-end portion of the ink storage body 30, and which derives frontward the ink inside the ink storage chamber 40, and an atmosphere infusing portion 32 which is provided at the front-end portion of the ink storage body 30, and which infuses from front side, an atmosphere into the ink storage chamber 40.

Figure 6:
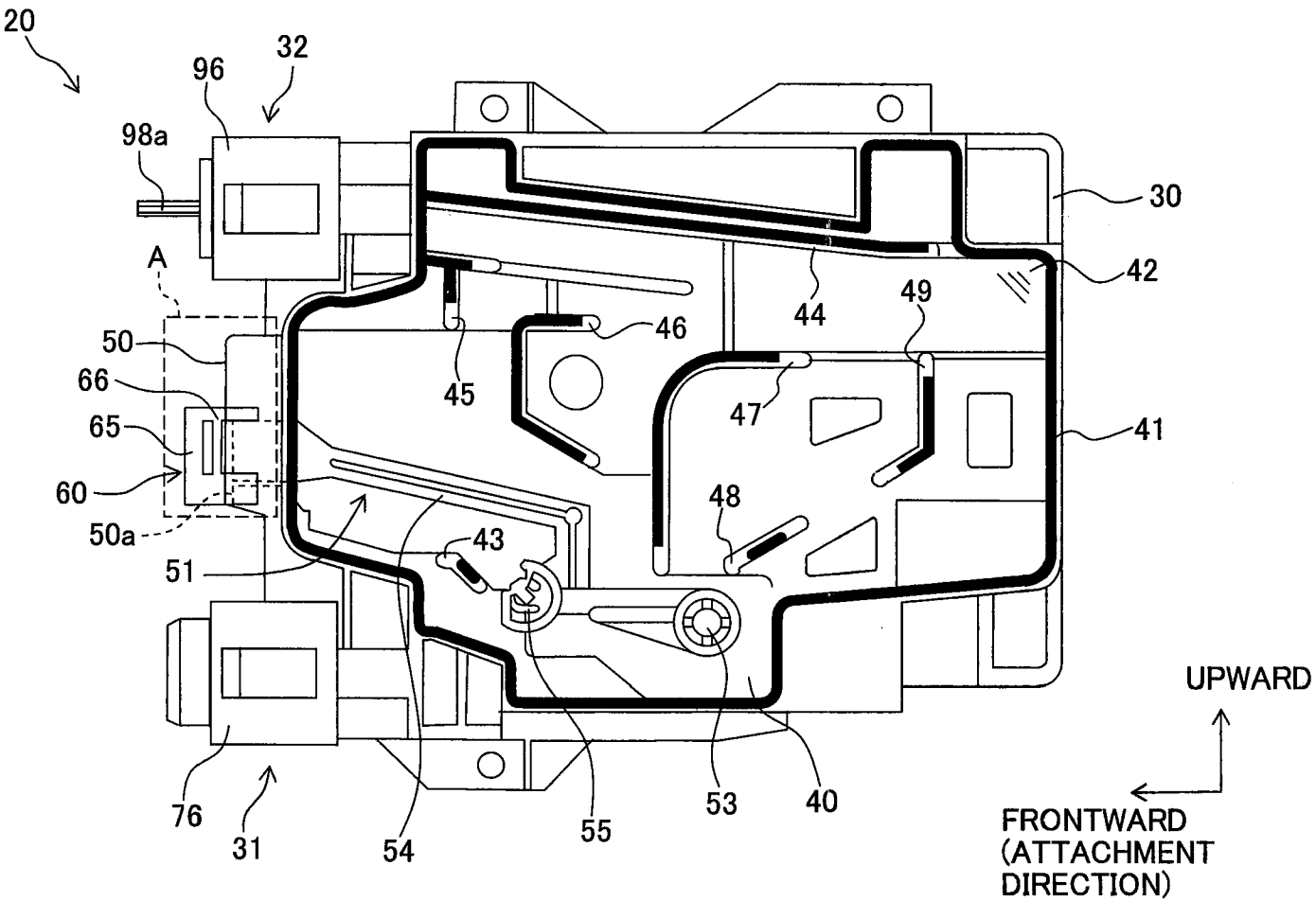
FIG. 6 is a side view of a cartridge main body.

As shown in FIG. 6, the ink storage body 30 has a frame portion 41, ribs 43, 44, 45, 46, 47, 48, and 49 (hereinafter, "ribs 43 to 49") connected to the frame portion 41, and two frames 42 which are welded from both sides (frontward side of a paper surface and a rearward side of the paper surface in FIG. 6) to the frame portion 41 and the ribs 43 to 49 (particularly, a portion colored in black in FIG. 6). By a space defined by the frame portion 41 being closed from both sides by the two frames 42, the ink storage chamber 40 which is a space inside which the ink is stored is formed. The frame 42 is welded to the frame portion 41 and the ribs 43 to 49 by ultrasonic welding for example.

Figure 7:
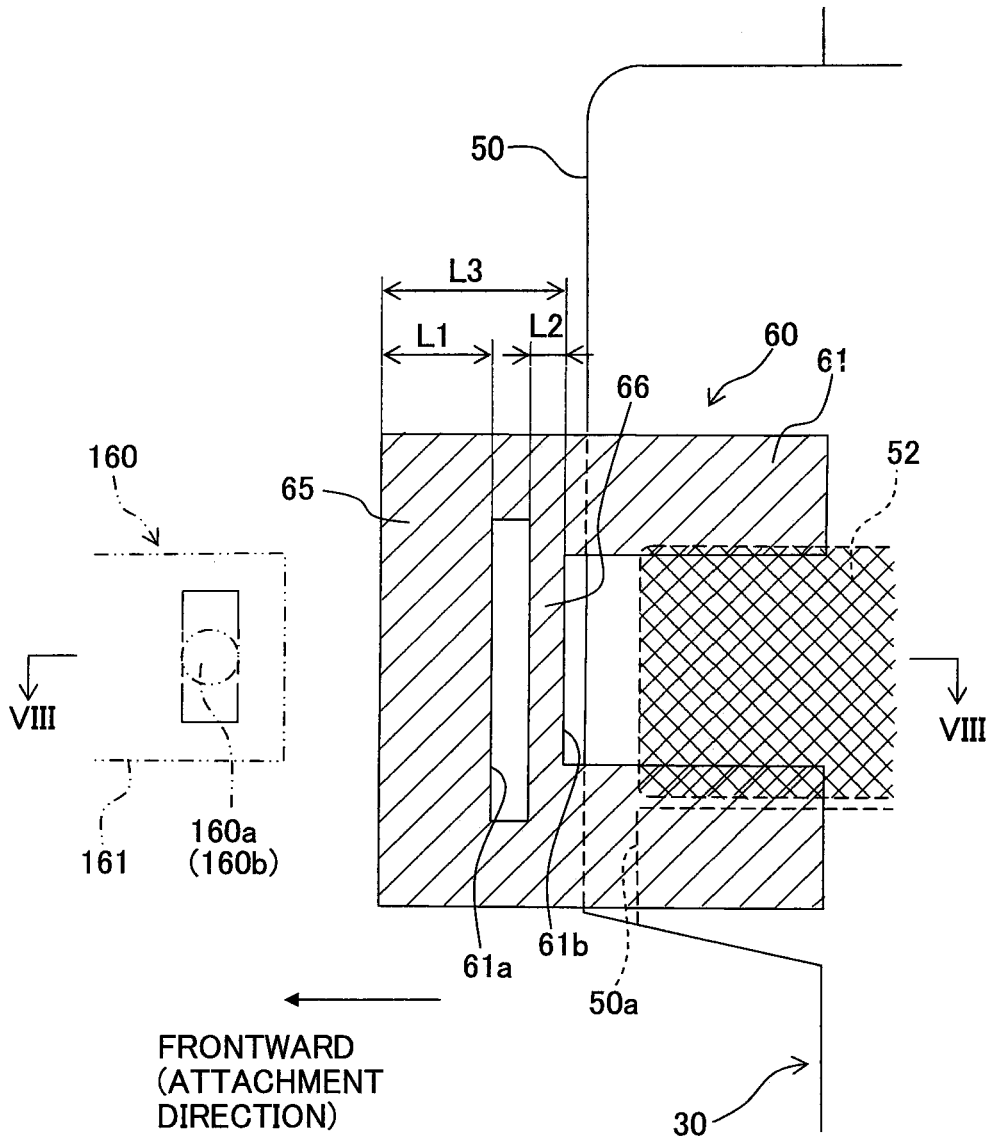
FIG. 7 is an enlarged view of a portion A, in FIG. 6.

Moreover, as shown in FIG. 6 and FIG. 7, a detection portion 50 which is to be detected and protrudes frontward (front-end side in the attachment direction) farther than the frame portion 41 to which the frame 42 is welded, and which is transparent is provided to the front-end portion (left-end portion in FIG. 6) of the ink storage body 30. An internal space of the detecting portion 50 communicates with the ink storage chamber 40 positioned at a rear side, crossing over the frame portion 41. A light shielding plate 52 of a sensor arm 51 which is installed inside the ink storage chamber 40 and which will be described later, is movable vertically inside the detecting portion 50. Moreover, in a state that the ink cartridge 4 is attached to the cartridge attachment portion 7 of the holder 5 (refer to FIG. 11), a lower-end portion of the detecting portion 50 is positioned between a light emitting portion 160*a* and a light receiving portion 160*b* of an optical sensor 160 (refer to FIG. 11) which will be described later. Furthermore, a shielding member 60 formed of a light shielding material for detecting upon distinguishing attachment and detachment of the ink cartridge 4 is attached to a lower-half portion of the detecting portion 50 from a front side.

The sensor arm 51 which is pivoted according to a fluctuation of an ink level (an amount of ink stored) inside the ink storage chamber 40 is provided at a lower half portion of the ink storage chamber 40. As shown in diagrams from FIG. 6 to FIG. 8, the sensor arm 51 has a light shielding plate 52 which is capable of shielding light of the optical sensor 160 provided to the cartridge attachment portion 7 that will be described later, a float portion 53, and an arm portion 54 which makes communicate the light shielding plate 52 and the float portion 53.

The arm portion 54 is extended in a substantially perpendicular direction from one end portion connected to the float portion 53 (right-end portion in FIG. 6), and is further extended to be slanting upward, and the light shielding plate 52 is connected to one end portion (left-end portion in FIG. 6) thereof. Moreover, the arm portion 54 is pivoted to an arm supporting portion 55 provided to the ink storage body 30, and the sensor arm 51 is structured to be pivotable with the arm supporting portion 55 as a center.

The light shielding plate 52 is accommodated in a space inside the detecting portion 50, and by pivoting of the sensor arm 51, the light shielding plate 52 moves vertically inside the detecting portion 50. When the ink cartridge 4, in a state of being attached to the cartridge attachment portion 7, is at a lower-end side inside the detecting portion 50, since the light shielding plate 52 shields light which is transmitted through the detecting portion 50 from the light emitting portion 160*a* of the optical sensor 160, it is detected by the optical sensor 160.

A volume of the float portion 53 is sufficiently larger than a volume of the light shielding plate 52. Moreover, since the sensor arm 51 is formed of a material having a specific gravity smaller than a specific gravity of the ink, a moment with the arm supporting portion 55 as a center acts on the sensor arm 51 due to gravity and buoyancy. In a state of the entire float portion 53 inside the ink, since the buoyancy acting on the float portion 53 is sufficiently larger than a buoyancy acting on the light shielding plate 52, a moment in a counterclockwise direction in FIG. 6 becomes greater than a moment in a clockwise direction. Therefore, when the entire float portion 53 is in the ink (in other words, when an amount remained of ink is sufficient), the light shielding plate 52 is always at the lower-end portion of the detecting portion 50, and shields light from the light emitting portion 160*a* of the optical sensor 160.

Whereas, when the ink inside the ink storage chamber 40 decreases, and a part of the float portion 53 is exposed from the ink level, a buoyancy generated in the float 53 is decreased, and the moment in the counterclockwise direction and the moment in the clockwise direction becomes same. Moreover, when the ink level goes on lowering further after the part of the float portion 53 is exposed, the float portion 53 moves downward according to a level fluctuation. Furthermore, with descending of the float portion 53, since the sensor arm 51 is pivoted in a clockwise direction in FIG. 6 with the arm supporting portion 55 as a center, the light shielding plate 52 moves upward, and the light from the light emitting portion 160*a* is not shielded.

Figure 8:
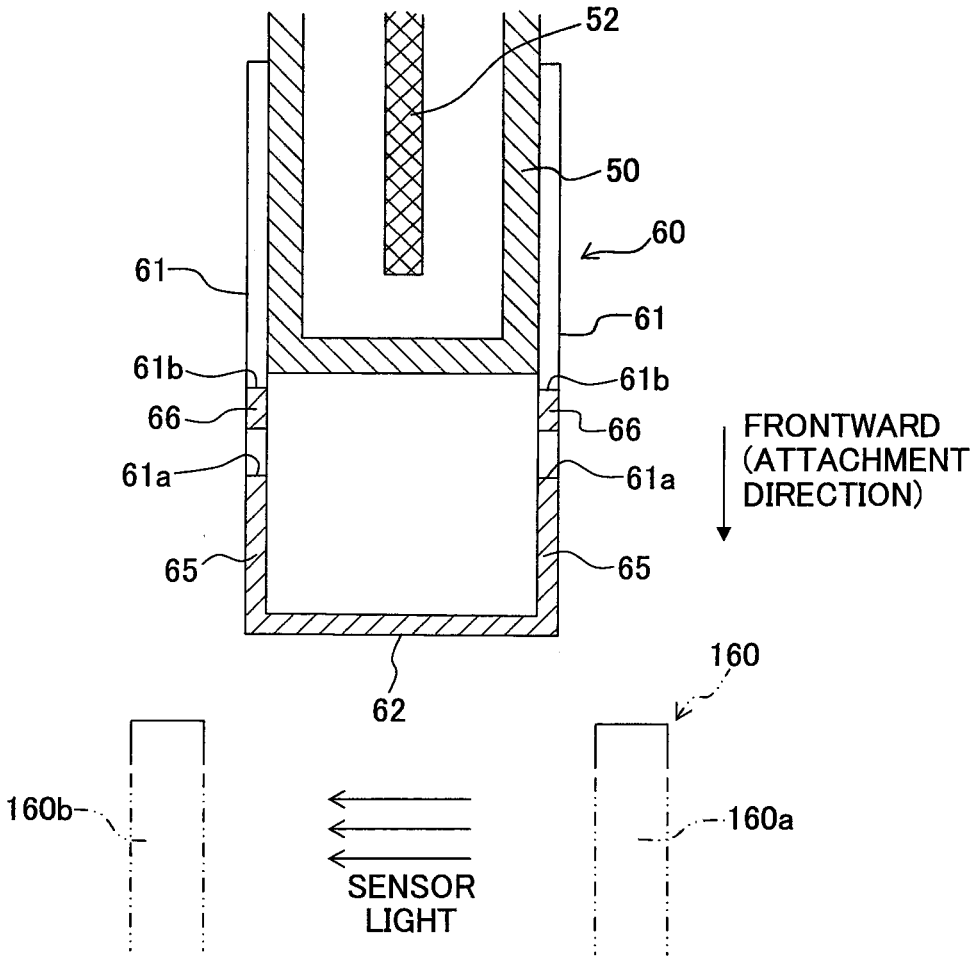
FIG. 8 is a cross-sectional view taken along a line VIII-VIII in FIG. 7.

As shown in diagrams from FIG. 6 to FIG. 8, the shielding member 60 made of a light shielding material attached to be fixed from a frontward direction, to the front-end portion of the detecting portion 50 in which the light shielding plate 52 which moves vertically according to the fluctuation of the ink level is accommodated. The light shielding member 60 is provided for detecting and distinguishing the attachment and detachment of the ink cartridge 4, and is incapable of a relative movement with respect to the detecting portion 50 of the cartridge main body 20.

The light shielding member 60 is formed of two side wall portions 61 which are extended frontward farther than a front end of the detecting portion 50, along two side surfaces of the detecting portion 50, and a connecting portion 62 which connects front ends of the two side wall portions 61.

As shown in FIG. 7 and FIG. 8, a slit 61*a* having a rectangular shape in a side view, which is extended vertically at a position separated away by a predetermined distance from a front end to a rearward side, and a notch portion 61*b* which is cut to be rectangular-shaped in a side view from a rear end to a frontward side, at a central portion in a vertical direction are formed in each side wall portion 61, leaving a space frontward and rearward. Moreover, in a state of the two side wall portions 61 sandwiching the detecting portion 50 from the width direction, at an upper and lower both side portions of the notch portion 61*b*, the light shielding member 60 is attached to the detecting portion 50.

Moreover, as shown in FIG. 6, positions at which the slit 61*a* and the notch portion 61*b* are formed between the two side wall portions 61, coincide at least in a frontward and rearward direction. Consequently, at these positions of the slit 61*a* and the notch portion 61*b*, light advancing in the width direction of the cartridge 4 (left right direction in FIG. 6) can pass through the light shielding member 60. Moreover, at the time of attaching or detaching the ink cartridge 4, when the ink cartridge 4 has moved in the frontward and the rearward direction, two light shielding portions 65 and 66 shield one after another, light of the optical sensor 60 of the cartridge attachment portion 7.

Furthermore, a distance L1 from a front end of the side wall portion 61 up to a front end of the slit 61*a* is longer than a distance L2 from a rear end of the slit 61*a* up to a front end of the notch portion 61*b*. Concretely, a length in the frontward and rearward direction of the light shielding portion 65 at a front side is not less than three times length of the light shielding portion 66 at a rear side.

According to such structure, the length in the frontward and rearward direction of the two light shielding portions 65 and 66 being different, at the time of attaching or detaching the ink cartridge 4, when the ink cartridge 4 has moved in the frontward and the rearward direction, the time at which the two light shielding portions 65 and 66 shields the light of the optical sensor 60 provided to the cartridge attachment portion 7 differs. Moreover, at the time of attaching the ink cartridge 4, the light is shielded in order of the light shielding portion 65 at the front side first and then the light shielding portion 66 at the rear side next, whereas, at the time of detaching the ink cartridge 4, the light is shielded in order of the light shielding portion 66 at the rear side first and then the light shielding portion 65 at the front side next. Therefore, at the time of attaching and detaching, there occurs a difference in a waveform pattern which is output from the optical sensor 160 at the time of attaching and detaching the cartridge 4, and it is possible to detect upon distinguishing the attachment and detachment of the ink cartridge 4.

Moreover, as shown in FIG. 5, the notch portion 61*b* which is a portion through which the light of the optical sensor 160 passes, overlaps partially with a lower end portion of the detecting portion 50 in the frontward and rearward direction. Consequently, in a state of the light shielding plate 52 of the sensor arm 51 at the lower end portion of the detecting portion 50 (in other words, in a state in which the amount of ink remained is sufficient), the two light shielding portions 65 and 66, and the light shielding plate 52 of the sensor arm 51 are arranged to be adjacent side-by-side in the frontward and rearward direction (attachment direction). Moreover, the front end of the notch portion 61*b* (in other words, the rear end of the light shielding portion 66 at the rear side) is ahead of the front end of the light shielding plate 52 positioned at the lower end portion of the detecting portion 50, and the light shielding portion 66 at the rear side and the light shielding plate 52 are arranged leaving a space in the frontward and the rearward direction. Accordingly, at the time of attaching and detaching the ink cartridge 4, the light from the light emitting portion 160*a* of the optical sensor 160 by being shielded by the two light shielding portions 65 and 66, it is possible to detect by distinguishing the attachment and detachment, and furthermore, after the attachment of the ink cartridge 4 is completed, it is possible to detect the amount of ink remained according to whether or not the light from the same light emitting portion 160*a* is shielded by the light shielding plate 52.

Next, the ink deriving portion 31 and the atmosphere infusing portion 32 (atmosphere communicating portion) of the ink cartridge 4 will be described below. As shown in FIG. 5 and FIG. 6, the ink deriving portion 31 and the atmosphere infusing portion 32 are extended frontward horizontally from both upper and lower end portions sandwiching the detecting portion 50 of a front wall portion (a wall portion at a front end side in the attachment direction) of the ink storage body 30. Moreover, an arrangement is made such that while infusing an atmosphere from front side to the ink storage chamber 40 inside the ink storage body 30 through the atmosphere infusing portion 32, the ink inside the ink storage chamber 40 is derived frontward from the ink deriving portion 31.

As shown in FIG. 6, when the ink cartridge 4 is in the attachment posture, the atmosphere infusing portion 32 is positioned at an upper-end side of the ink storage body 30, and the ink deriving portion 31 is positioned at a lower-end side of the ink storage body 30. Therefore, it is possible to infuse the atmosphere smoothly in an upper space of the ink storage chamber 40, and to discharge the ink remained in the lower space of the ink storage chamber 40 till end as far as possible.

Although it is not shown in the diagram, an ink deriving channel which communicates with the ink storage chamber 40 of the ink storage body 30, and an opening and closing valve which opens and closes the ink deriving channel are provided inside the ink deriving portion 31. The opening and closing valve, when the ink cartridge 4 is attached to the cartridge attachment portion 7 that will be described later, moves in a direction of opening the ink deriving channel by an ink extracting tube 163 (refer to FIG. 11 and FIG. 12) provided to the cartridge attachment portion 7. Moreover, an atmosphere infusing channel which communicates with the ink storage chamber 40, and an opening and closing valve which opens and closes the atmosphere infusing channel are provided inside the ink storage body 30. A pin 98*a* which protrudes further from a front end of the atmosphere infusing portion 32 is provided to the opening and closing valve. By the pin 98*a* being pushed when the ink cartridge 4 has been attached to the cartridge attachment portion 7 that will be described later, the opening and closing valve moves in a direction of opening the atmosphere infusing channel.

Next, the external case 21 which covers the cartridge main body 20 described above will be described by referring to FIG. 4 and FIG. 5. The external case 21 is a block having a substantially rectangular parallelepiped shape, and is formed of two case members (a first case member 23 and a second case member 24) which sandwich the ink storage body 30 from both sides in the direction of a width.

The first case member 23 and the second case member 24 are formed to have substantially the same shape. Case notch portions 110 and 111 which form substantially circular-shaped through holes exposing a part of the ink deriving portion 31, and case notch portions 112 and 113 which form a substantially circular-shaped through holes exposing a part of the atmosphere infusing portion 32 are formed at a front end portion of the first case member 23 and the second case member 24, in a state of sandwiching the ink storage body 30. Furthermore, case notch portions 114 and 115 which form through holes for inserting the detecting portion 50 and the light shielding member 60 (refer to diagrams from FIG. 6 to FIG. 8) into the optical sensor 160 provided to the cartridge attachment portion 7 (refer to FIG. 11 and FIG. 12) are formed at the front end portion of the first case member 23 and the second case member 24.

Stepped portions 120 and 121 which are lower by a step than a surface of the first case member 23 are formed in both upper and lower end portions (both end portions in a width direction of the ink cartridge 4) of the first case member 23, to be extended in a frontward and a rearward direction (longitudinal direction of the ink cartridge 4). Similarly, stepped portions 122 and 123 which are lower by a step than a surface of the second case member 24 are formed in both upper and lower end portions of the second case member 24, to be extended in the frontward and rearward direction. The relatively facing first case member 23 and the second case member 24 are welded at the stepped portions 120, 121, 122, and 123 (hereinafter, "stepped portions 120 to 123"). Furthermore, the stepped portions 120 to 123 have protrusions 120*a*, 121*a*, 122*a*, and 123*a* (hereinafter, "protrusions 120*a* to 123*a*") respectively, which protrude frontward farther than a front end surface of the first case member 23 and the second case member 24. Fitting grooves 120*b* and 122*b* which are extended rearward are formed in the two protrusions 120*a* and 122*a*.

Moreover, in the second case member 24, an engaging portion 123*b* which protrudes from a surface of the stepped portion 123 up to a height, to be in the same plane as a surface of the second case member 24, and which extends downward is formed in the second case member 24. Although it is not shown in FIG. 5, an engaging portion 121*b* similar to the engaging portion 123*b* is formed also in the stepped portion 121 of the first case member 23. Furthermore, recesses 120*c* and 122*c* are formed in the stepped portion 120 at an upper side of the first case member 23, and the stepped portion 122 at an upper side of the second case member 24, at substantially intermediate positions with respect to the frontward and rearward direction.

Next, the protector 22 will be described below by referring to FIG. 4 and FIG. 5. The protector 22 is a member which covers the front end portion of the ink storage body 30 which is provided with the ink deriving portion 31 and the atmosphere infusing portion 32, and is a member which protects the ink deriving portion 31 and the atmosphere infusing portion 32 when the ink cartridge 4 is shipped. As shown in FIG. 5, a protector through hole 22*a* is formed in the protector 22 at a location corresponding to the atmosphere infusing portion 32. Therefore, it is possible to cover the ink deriving portion 31, and to cover the atmosphere infusing portion 32 while relieving the pin 98*a* in the protector through hole 22*a*, and to protect both the ink deriving portion 31 and the atmosphere infusing portion 32 assuredly. The ink cartridge 4 is attached to the cartridge attachment portion 7 of the holder 5 which will be described next, in a state of the protector 22 is detached.

As it has been described before, the inks of two colors (light cyan and light magenta) to be used in the second head 2 which is a serial head are inks having a low frequency of use, and in a case of normal printing, in many cases it is possible to deal with only by the basic inks of four colors. Therefore, in the first embodiment, when the inks of these two colors (light cyan and light magenta) are not to be used, it is possible to attach a dummy cartridge 70 which does not store an ink, instead of the ink cartridges 4*e* and 4*f* as an ink supply source, on the two cartridge attachment portions 7*e* and 7*f* corresponding to the second head 2. By this dummy cartridge 70 being attached to the cartridge attachment portion 7 of the holder 5, a communication with the atmosphere of one ink supply portion (liquid supply section) communicating with the second head 2 from this cartridge attachment portion 7 via the tube 11 is blocked, and a supply of ink from this ink supply portion to the second head 2 is stopped. In other words, this dummy cartridge corresponds to a blocking mechanism of the present invention.

Figure 9:
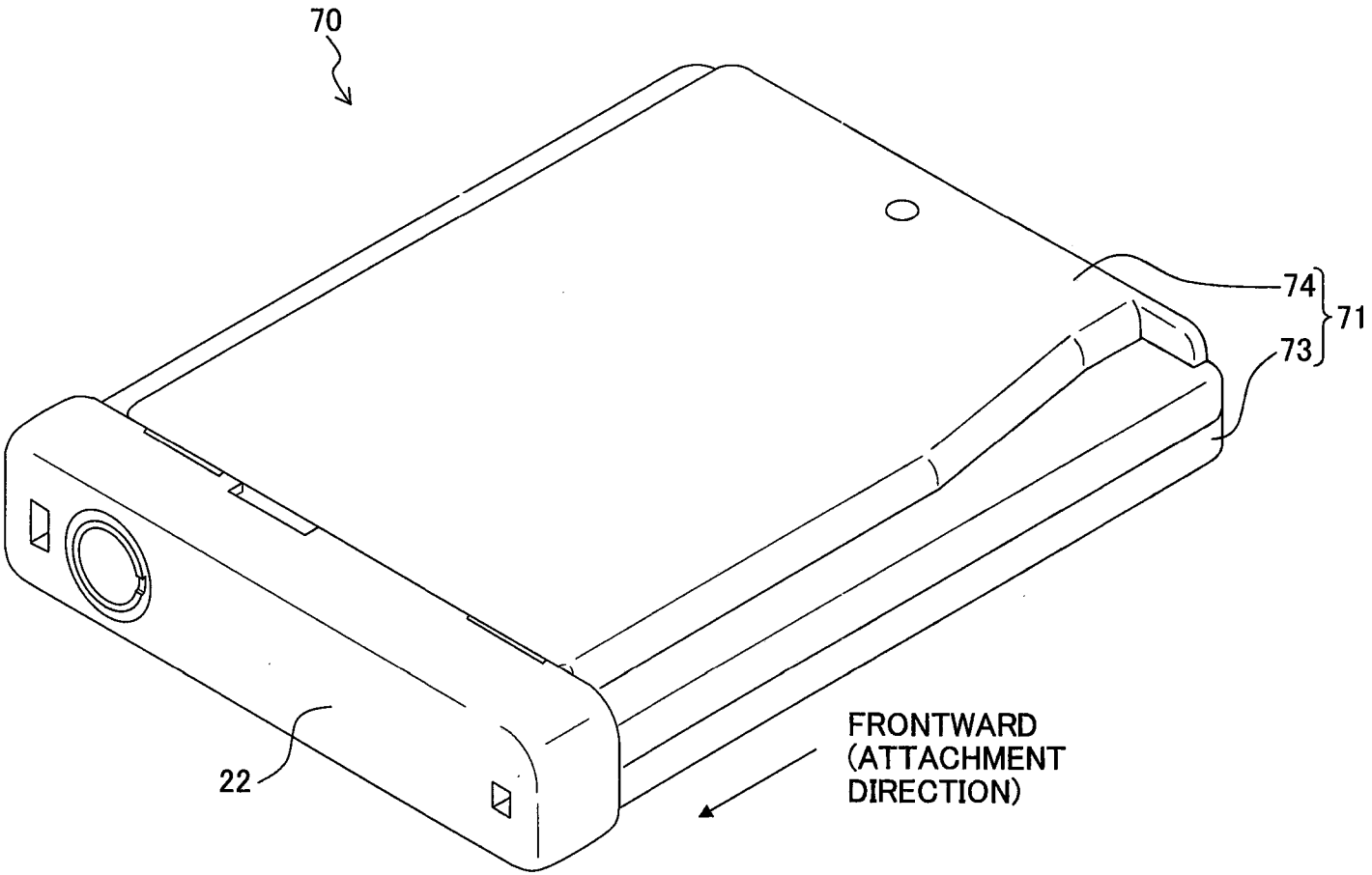
FIG. 9 is an external perspective view of a dummy cartridge.
Figure 10:
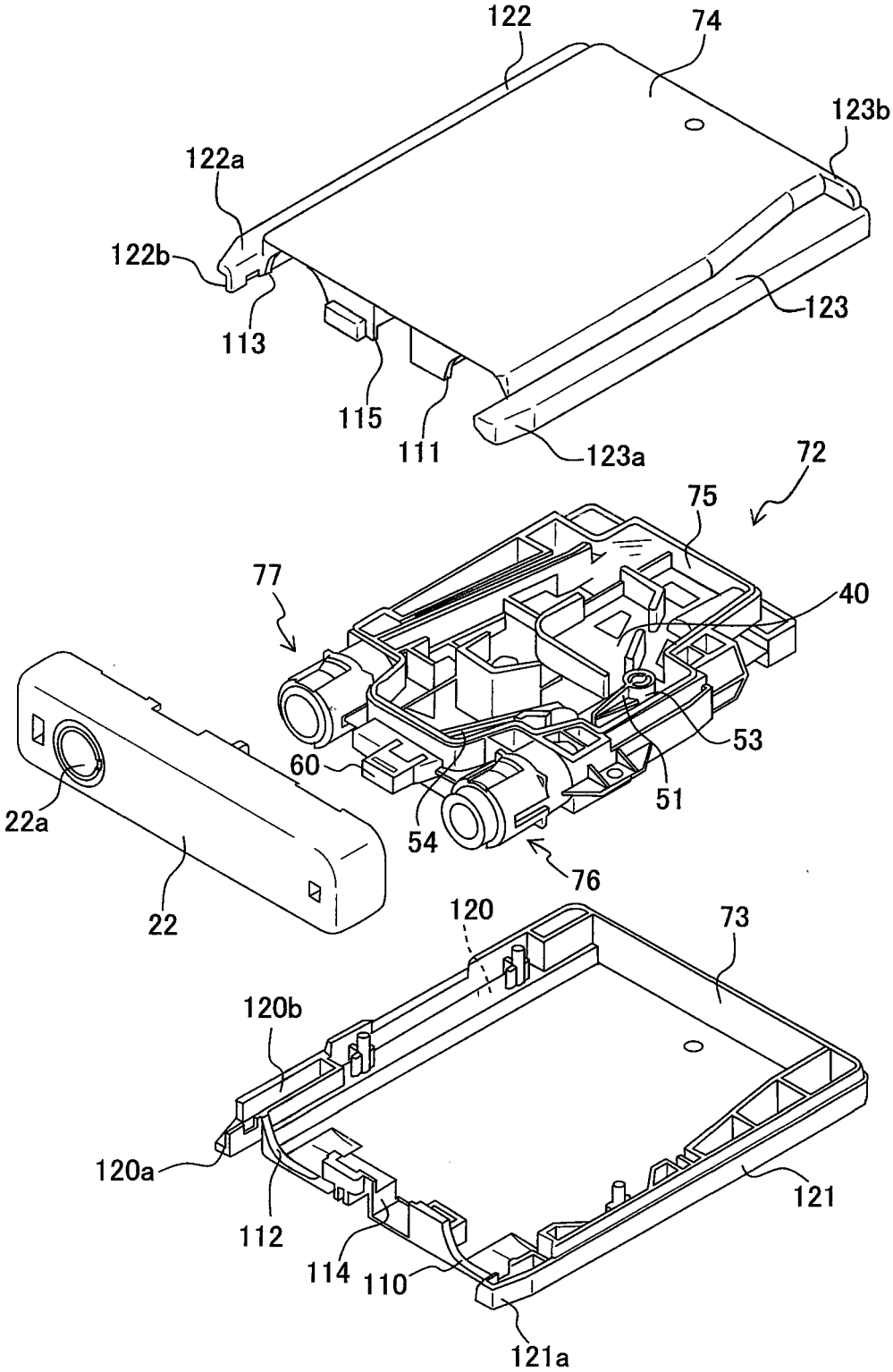
FIG. 10 is an exploded perspective view of the dummy cartridge.

A structure of the dummy cartridge 70 will be described below. As shown in FIG. 9 and FIG. 10, the dummy cartridge 70 has a structure like the structure of the ink cartridge 4 described earlier (refer to FIG. 4 and FIG. 5). However, as it will be described below, the dummy cartridge 70 has some characteristics different from the ink cartridge 4.

The dummy cartridge 70 has a cartridge main body 72, an external case 71 made of a first case member 73 and a second case member 74, and the protector 22. Moreover, the cartridge main body 72 has a dummy storage body 75, a dummy ink deriving portion 76, and a dummy atmosphere infusing portion 77.

In FIG. 10, a storage body having a same structure as the ink storage body 30 of the ink cartridge 4 is shown as the dummy storage body 75. However, originally, since the dummy storage body 75, unlike the ink storage body 30, does not store ink, an internal structure thereof may be simplified. For example, the sensor arm 51 which has been provided to the ink storage body 30 may be omitted. Moreover, since the dummy ink deriving portion 76, unlike the ink deriving portion 31 of the ink cartridge 4 (refer to FIG. 5), does not require a function of deriving ink, an internal structure thereof (such as an opening and closing valve) may be simplified.

Moreover, in the first embodiment, a function of the dummy cartridge 70 is to block a communication between an ink supply channel and the atmosphere such that air does not enter the ink supply channel from the cartridge attachment portion 7*e* (7*f*) up to the second head 2 via the tube 11. Therefore, the dummy atmosphere infusing portion 77 of the dummy cartridge 70 has a structure which blocks the communication with the atmosphere all the time such that the atmosphere is not infused into the cartridge (dummy storage body 75). In other words, the opening and closing valve etc. including the pin 98*a* (refer to FIG. 5) which has been provided to the atmosphere infusing portion 32 of the ink cartridge 4 is not provided to the dummy atmosphere infusing portion 77, and instead, by providing a partition wall etc., a space inside the dummy storage body 75 is always in a state of being blocked from the atmosphere all the time. In the first embodiment, when the dummy cartridge 70 is to be attached to the cartridge attachment portion 7*e* (7*f*), the cartridge attachment portion 7*e* (7*f*) and the tube 11 are defined as an ink supply portion. In other words, when the dummy cartridge 70 is to be attached to the cartridge attachment portion 7*e* (7*f*), the dummy cartridge 70 is not included in the ink supply portion.

Furthermore, as shown in FIG. 9 and FIG. 10, in the external case 71 of the dummy cartridge 70, unlike in the external case 21 of the ink cartridge 4 (refer to FIG. 4 and FIG. 5), the recesses 120*c* and 122*c* are not formed at an upper portion thereof. Moreover, between the ink cartridge 4 and the dummy cartridge 70 due to a difference in an external shape because of the presence and absence of the recesses 120*c* and 122*c*, by an optical sensor 162 (refer to FIG. 11 and FIG. 12) provided to the holder 5 that will be described later, it is possible to make a judgment of whether the cartridge attached to the cartridge attachment portion 7 is the ink cartridge 4 or the dummy cartridge 70.

Next, a structure of the holder 5 to which the ink cartridge 4 described above is attached will be described below in detail. The six cartridge attachment portions 7*a* to 7*f* of the holder 5 have almost the same structure. However, as it is possible to attach the dummy cartridge 70 to the two cartridge attachment portions 7*e* and 7*f* corresponding to the second head 2, it has a structure slightly different from the four cartridge attachment portions 7*a* to 7*d* corresponding to the first head 1. The following description is for the cartridge attachment portions 7*e* and 7*f* corresponding to the second head 2, and regarding the cartridge attachment portions 7*a* to 7*d* corresponding to the first head 1, and only the points of difference will be described.

Figure 11:
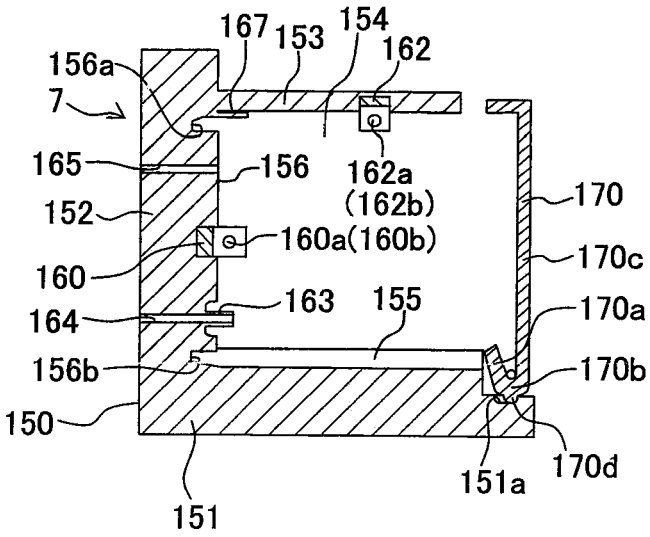
FIG. 11 is a cross-sectional view of a holder shown schematically in FIG. 1, at a surface including a attachment direction of the ink cartridge (a direction perpendicular to paper surface in FIG. 1)

As shown in FIG. 1 and FIG. 11, the holder 5 includes a holder main body 150 having a substantially rectangular parallelepiped shape, and the holder main body 150 is provided with six cartridge attachment portions 7*a* to 7*f* arranged side-by-side in a horizontal direction. One cartridge attachment portion 7 includes a bottom wall portion 151 which is horizontal, an inner wall portion 152 which extends in a vertical direction from an inner end portion (left-end portion in the diagram: an end portion at an inner side in the attachment direction) of the bottom wall portion 151, and an upper wall portion 153 which extends almost horizontally from an upper end portion of the inner wall portion 152, facing the bottom wall portion 151. A cartridge accommodating chamber 154 in which the ink cartridge 4 is accommodated is formed at an inner side of the bottom wall portion 151, the inner wall portion 152, and the upper wall portion 153.

On an upper end surface of the bottom wall portion 151, a supporting portion 155 which supports from a lower side of the attached ink cartridge 4, is formed as a recess corresponding to the stepped portions 121 and 123 (refer to FIG. 5) at a lower portion of the external case 21.

Moreover, as a structure peculiar to the cartridge attachment portions 7*e* and 7*f* corresponding to the second head 2, the optical sensor 162 which has a light emitting portion 162*a* and a light receiving portion 162*b* facing mutually, with respect to the width direction of the ink cartridge 4 (direction perpendicular to paper surface in FIG. 10) is provided at a half-way portion in a longitudinal direction of the upper wall portion 153. The optical sensor 162 is provided such that, when the ink cartridge 4 (or the dummy cartridge 70) is attached, the optical sensor 162 protrudes toward an inner side from the upper wall portion 152 such that a central portion of an upper portion of the external case 21 (71) is inserted between the light emitting portion 162*a* and the light receiving portion 162*b*. The optical sensor 162 is not provided to the cartridge attachment portions 7*a* to 7*d* corresponding to the first head 1.

An inner surface of the inner wall portion 152 is an attachment surface 156 which makes a contact with a front-end surface of the ink cartridge 4 accommodated in the cartridge accommodating chamber 154. The optical sensor 160 having the light emitting portion 160*a* and the light receiving portion 160*b* facing mutually in the width direction of the ink cartridge 4 is provided at a position of the attachment surface 156, on somewhat lower side than a central portion in the vertical direction. The optical sensor 160 protrudes from the attachment surface 156 such that, when the ink cartridge 4 is attached, the light emitting portion 160*a* and the light receiving portion 160*b* are inserted into the through holes (through holes made of the case notch portions 114 and 115) formed in the front end surface of the external case 21 shown in FIG. 5.

The ink extracting tube 163 which protrudes horizontally is provided at a position of the attachment surface 156, on a lower side of the optical sensor 160 (a position corresponding to the ink deriving portion 31 of the ink cartridge 4). The ink extracting tube 163 communicates with an ink channel 164 formed in the inner wall portion 152, and furthermore, the ink channel 164 is connected to the first head 1 or the second head 2 via the tube 10 or the tube 11 (refer to FIG. 1). Moreover, as it will be described later, the ink extracting tube 163 is inserted into the ink deriving portion 31 with an attachment operation of the ink cartridge 4, and at that time, the ink deriving channel is opened by operating the opening and closing valve in the ink deriving portion 31. On the other hand, a position of the attachment surface 156, at an upper side of the optical sensor 160 (a position corresponding to the atmosphere infusing portion 32 of the ink cartridge 4) is on a flat surface. An atmosphere communicating channel 165 which opens near the flat surface, and which communicates with an outside (the atmosphere) is formed in the inner wall portion 152.

A protrusion 156*a* corresponding to the protrusions 120*a* and 122*a* of the external case 21 shown in FIG. 5, and a protrusion 156*b* corresponding to the protrusions 121*a* and 123*a* are formed on both upper and lower end portions of the attachment surface 156. Moreover, at a position adjacent to a recess 156*a* at an upper side (the upper wall portion 153 side), a fitting rod 167 which is pierced through the fitting grooves 120*b* and 122*b* of the external case 21 extends rearward.

Furthermore, a lid member 170 for locking the ink cartridge 4 accommodated in the cartridge accommodating chamber 154, such that the ink cartridge 4 is immovable in the frontward and rearward direction is provided at a front end portion (an entrance portion of the cartridge accommodating chamber 154) of the bottom wall portion 151. The lid member 170 is pivoted by being engaged with the engaging portions 121*b* and 123*b* of the external case 21 shown in FIG. 5.

Next, a series of operations at the time of attaching the ink cartridge 4 or the dummy cartridge 70 will be described below.

Firstly, a case in which the ink cartridge 4 which stores ink is attached to the cartridge attachment portion 7 will be described below. The ink cartridge 4 is attached to the cartridge attachment portion 7, in a state of the protector 22 removed.

Figure 12A:
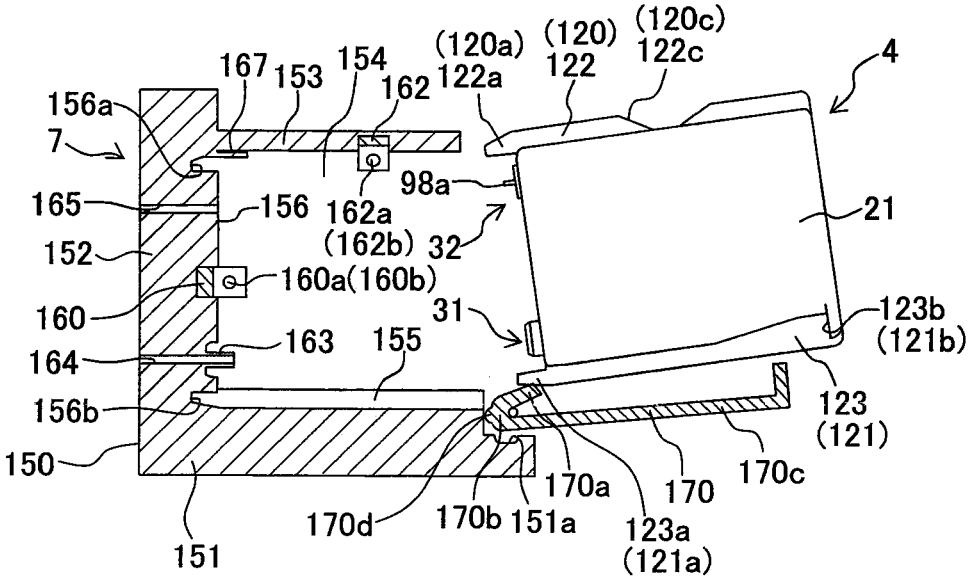
FIG. 12A is a diagram showing a state of starting attachment of the ink cartridge.

At the time of attaching the ink cartridge 4 to the cartridge attachment portion 7, a cover portion 170*c* of the lid member 170 of the predetermined cartridge attachment portion 7 is pivoted by bringing down toward front, and the cartridge accommodating chamber 154 is let to be in an open state. From this state, as shown in FIG. 12A, the ink cartridge 4 is inserted gradually into the cartridge accommodating chamber 154, by upon bringing the protrusions 121*a* and 123*a* (a front end portion of the stepped portions 121 and 123) of the external case 21 in contact with the supporting portion 155 formed in the bottom wall portion 151. When the ink cartridge 4 is tucked gradually into inner side of the cartridge accommodating chamber 154, the engaging portion 170*a* of the lid member 170 is engaged with the engaging portions 121*b* and 123*b* of the rear end portion of the external case 21, and the lid member 170 is pivoted in a direction of closing the cartridge accommodating chamber 154, with an axial portion 170*b* as a center.

At this time, the fitting rod 167 is inserted into the fitting grooves 120*b* and 122*b* (refer to FIG. 5) of the external case 21. Accordingly, in a case of attaching the ink cartridge 4 in a reverse posture of up-side-down (a posture in which the ink deriving portion 31 is up and the atmosphere infusing portion 32 is down), being hindered by the fitting rod 167, the ink cartridge 4 cannot be inserted into the cartridge accommodating chamber 154, and wrong attachment of the ink cartridge 4 is prevented.

Figure 12B:
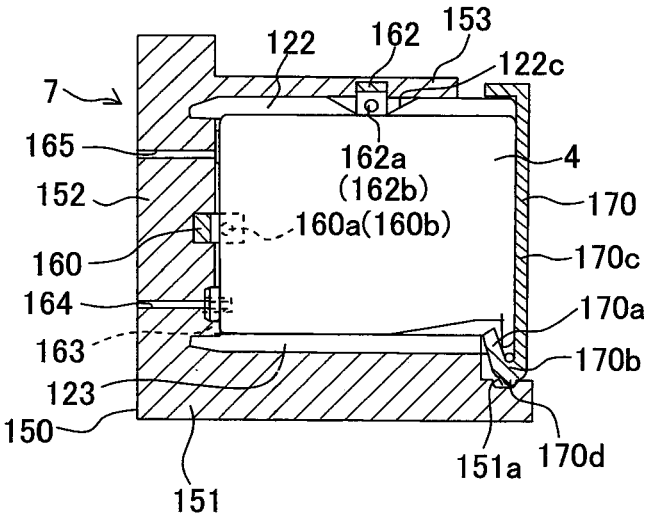
FIG. 12B is a diagram showing a state in which the attachment of the ink cartridge is completed.

When the user turns the lid member 170 after the ink cartridge 4 is inserted up to an inner side of the cartridge accommodating chamber 154, as shown in FIG. 12B, a projection 170*d* of the lid member 170 is engaged with a recess 151*a* of the bottom wall portion 151. Accordingly, the lid member 170 is not pivotable with respect to the bottom wall portion 151, and by the lid member 170, the ink cartridge 4 is locked assuredly not to come off from the cartridge accommodating chamber 154.

At this time, the front end surface of the ink cartridge 4 makes a contact with the attachment surface 156 of the inner wall portion 152, and by the ink extracting tube 163 being inserted into the ink deriving portion 31, the opening and closing valve at the interior is operated, and the ink deriving channel is opened. At the same time, by the pin 98*a* of the atmosphere infusing portion 32 being pushed upon making a contact with the attachment surface 156, the opening and closing valve inside the atmosphere infusing portion 32 is operated, and the atmosphere infusing channel is opened. Accordingly, the atmosphere is infused into the ink supply chamber 40 from the atmosphere communicating channel 165, and also the ink inside the ink storage chamber 40 is supplied to the second head 2 via the ink extracting tube 163 and the ink channel 164.

Simultaneously with the attachment of the ink cartridge 4, the light emitting portion 160*a* and the light receiving portion 160*b* of the optical sensor 160 are inserted into the through hole (the through hole formed by the case notch portions 114 and 115: refer to FIG. 5) in the front end surface of the external case 21. At this time, firstly, the light shielding member 60 passes between the light emitting portion 160*a* and the light receiving portion 160*b*. Therefore, light from the light emitting portion 160*a* is shielded (the optical sensor 160 becomes ON) at a certain time interval by the two light shielding portions 65 and 66 (refer to FIG. 7) having a mutually different length with respect to the frontward and rearward direction (attachment direction, direction in which the ink is derived), provided to the light shielding member 60. Accordingly, two output waveforms having different length are output from the optical sensor 160 to the control unit 8. Accordingly, the control unit 8 identifies that some sort of cartridge has been attached. Moreover, the upper wall portion 153 of the cartridge attachment portion 7 is also provided with the optical sensor 162, and when the ink cartridge 4 is attached to the cartridge attachment portion 7, light from the optical sensor 162 passes through a recess formed in an upper portion thereof, and the light is not shielded. Accordingly, the control unit 8 identifies that the cartridge which has been attached, is the ink cartridge 4 that stores the ink.

Furthermore, as shown in FIG. 12B, in a state of the attachment of the ink cartridge 4 completed, the light emitting portion 160*a* and the light receiving portion 160*b* are facing with each other sandwiching a lower end portion of the detecting portion 50 of the ink storage body 30. Moreover, when there is a sufficient amount of ink remained inside the ink storage chamber 40, the light shielding plate 52 of the sensor arm 51 being positioned at the lower end portion of the detecting portion 50, the light from the light emitting portion 160*a* is shielded by the light shielding plate 52, and the optical sensor 160 becomes ON. Whereas, when there is no ink inside the ink storage chamber 40, the light shielding plate 52 of the sensor arm 51 not being positioned at the lower end portion of the detecting portion 50, the light from the light emitting portion 160*a* is not shielded by the light shielding plate 52, and the light is received at the light receiving portion 160*b*. Therefore, the optical sensor 160 becomes OFF. Accordingly, as to whether or not there is ink in the attached ink cartridge 4 is identified by the control unit 8.

Conversely, at the time of removing the ink cartridge 4 from the cartridge attachment portion 7, firstly, the lid member 170 is brought down toward a frontward side and is pivoted toward an opening position. As the lid member 170 is rotated, the projection 170*d* of the lid member 170 comes off the recess 151*a* of the bottom wall portion 151, and a state of being locked by the lid member 170 is released. Therefore, a state, in which it is possible to take out the ink cartridge 4 by pinching by fingers is assumed.

Moreover, at the time of taking the ink cartridge 4 out, the light emitting portion 160*a* and the light receiving portion 160*b* of the optical sensor 160 come out of the through hole formed in the front end surface of the external case 21. At this time, similarly as at the time of attachment, the light shielding member 60 passes between the light emitting portion 160*a* and the light receiving portion 160*b*, and the light from the light emitting portion 160*a* is shielded instantaneously by the two light shielding portions 65 and 66 provided to the light shielding member 60. Accordingly, a signal made of two waveforms having a different length is outputted from the optical sensor 160 to the control unit 8. However, since the length of the two light shielding portions 65 and 66 in the frontward and rearward direction differs mutually, a pattern of a waveform of an output signal which is output from the optical sensor 160 at the time of detachment is reverse to that at the time of attachment. From the difference in the waveform of the output signal, the control unit 8 identifies that the ink cartridge 4 has been detached.

Figure 13:
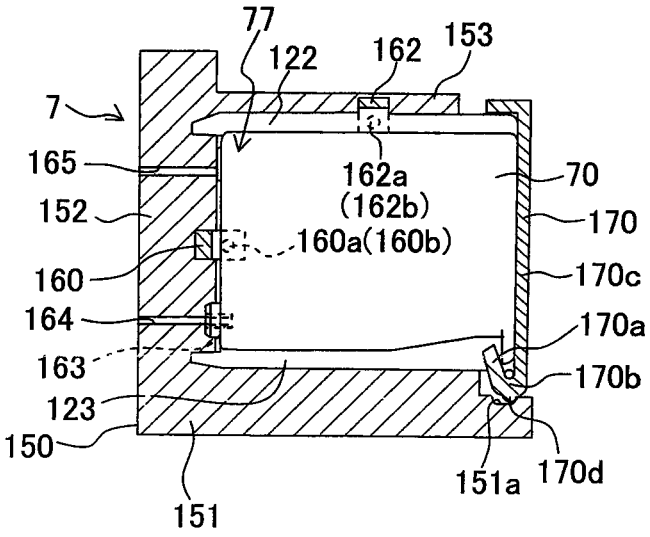
FIG. 13 is a diagram explaining an attachment operation of the dummy cartridge.

Next, a case to which the dummy cartridge 70 is attached instead of the ink cartridge 4 on the cartridge attachment portions 7*e* and 7*f* corresponding to the second head 2 will be described below by referring to FIG. 13. The attachment of the dummy cartridge 70 is almost same as the attachment of the ink cartridge 4 described above. After opening the cartridge accommodating chamber 154 by pivoting the lid member 170, the dummy cartridge 70 is pushed inward, and after the front end surface thereof is brought in contact with the attachment surface 156, the lid member 170 is returned to its original position and locked.

However, as it has been described earlier, the partition wall etc. is provided inside the dummy atmosphere infusing portion 77 of the dummy cartridge 70 such that the inside of the dummy cartridge 70 (the dummy storage body 75 inside) and the atmosphere are not let to communicate. Consequently, when the dummy cartridge 70 is attached to the cartridge attachment portions 7*e* and 7*f* corresponding to the inks (of light cyan color or light magenta color) to be used in the second head 2, the communication with the atmosphere, of the ink supply portion from the cartridge attachment portion 7 up to the second head 2 via the tube 11 is blocked, and the ink is not supplied any more to the second head 2 from this ink supply portion.

Moreover, in the dummy cartridge 70, unlike in the ink cartridge 4, the recess is not provided at a central portion at an upper part thereof. Therefore, as shown in FIG. 13, the light from the optical sensor 162 provided to the upper wall portion 153 of the cartridge attachment portion 7 is shielded by the dummy cartridge 70. Moreover, by the signal of the optical sensor 162 being output to the control unit 8 that will be described later, the control unit 8 identifies that the attached cartridge is not the ink cartridge 4, but the dummy cartridge 70.

Next, the purge unit 6 which carries out a purge for recovering a jetting performance of the first head 1 and the second head 2 will be described below. As shown in FIG. 1, the purge unit 6 includes a first suction cap 25 which is attachable to the first head 1, a second suction cap 26 which is attachable to the second head 2, and a suction pump 19 which is to be connected to both the first suction cap 25 and the second suction cap 26. Moreover, a switching unit 17 is provided between the first suction cap 25 and the second suction cap 26, and the suction pump 19. A destination of communication of the suction pump 19 is switched selectively between the first suction cap 25 and the second suction cap 26 by the switching unit 17.

The first suction cap 25 is formed of a flexible material such as rubber or a synthetic resin material, and has four cap portions 25*a* covering lower surfaces of the four first heads 1 respectively. A rib portion 25*b* is provided at an outer edge portion of each of the four cap portions 25*a*. Moreover, the first suction cap 25 is structured to be movable in a horizontal direction (parallel to the paper surface in FIG. 1) and a vertical direction (perpendicular to the paper surface in FIG. 1) by a drive mechanism including a motor etc. The first suction cap 25, during printing by the first head 1, is retracted to a position at an outer side in the width direction of the printing paper P with respect to the paper transporting path R. Whereas, when the first head 1 is not used, the first suction cap 25 moves up to a position facing a lower surface (liquid droplet jetting surface) of the first head 1, and further, moves upward and makes a contact with the lower surface of the first head 1. At this time, the four rib portions 25*b* make a close contact with the lower surface of the four first heads 1 respectively, and by the nozzles 13 of the four first heads 1 (refer to FIG. 2) being covered by the four cap portions 25*a*, communicate in common with the suction pump 19.

Accordingly, drying of ink inside the nozzles 13 of the first head 1 is prevented when the liquid droplets are not jetted. Moreover, in a case of performing the suction purge for recovery of the jetting function of the first head 1, suction by the suction pump 19 is performed upon switching the destination of communication of the suction pump 19 to the first suction cap 25 by the switching unit 17. Accordingly, by discharging forcibly the ink from the nozzles 13 toward the cap portion 25*a* by reducing a pressure inside the cap portion 25*a*, thickened ink and an air bubble, or impurities inside the first head 1 are discharged.

The second suction cap 26, similarly as the first suction cap 25, is formed of a flexible material such as rubber or a synthetic resin material, and a lip portion 26*a* is provided to an outer edge portion thereof. Moreover, the second suction cap 26 is arranged at a position (a purge position) of an outer side in the width direction of the printing paper P with respect to the paper transporting path R (right side in FIG. 1), and is structured to be movable in the vertical direction (direction perpendicular to the paper surface in FIG. 1) by a drive mechanism including a motor etc., at the purge position.

In a case of performing the suction purge for the recovery of the jetting function of the second head 2, the carriage 9 having the second head 2 mounted thereon is moved up to the purge position, and a lower surface (liquid droplet jetting surface) of the second head 2 is brought face-to-face with the second suction cap 26. In this state, by moving the second suction cap 26 upward, and by the lip portion 26*a* thereof making a close contact with the lower surface of the second head 2, the nozzles 16 of the second head 2 are covered by the second suction cap 26. The nozzles 16*e* and 16*f* of two types of the second head 2 which jet the light cyan ink and the light magenta ink respectively, are covered by one second suction cap 26.

Furthermore, when the destination of communication of the suction pump 19 is switched to the second suction cap 26 by the switching unit 17, both the nozzles 16*e* and 16*f* of two types, of the second head 2 communicate with one suction pump 19. Moreover, by discharging forcibly the ink from the nozzles 16*e* and 16*f* of two types toward the second suction cap 26 by reducing a pressure inside the second suction cap 26 by performing the suction by the suction pump 19, thickened ink and an air bubble, or impurities inside the second head 2 are discharged.

The suction pump 19 is not restricted to be of a particular type, and it is possible to use a pump of a type, in which a fluid inside a tube is pressure fed by rotating a roller while allowing the roller to make a pressed contact with an outer surface of the tube which is flexible (a so-called tube pump). In the tube pump, by controlling a rotational speed of the roller which is driven and rotated by a motor, it is possible to adjust a speed of pressure feeding of the fluid in the tube, or in other words, a suction speed of the ink from the nozzle. Moreover, by controlling the total number of rotations of the roller in one suction, it is possible to adjust an amount of liquid in the tube which is pressure fed, in other words, an amount of ink which is sucked and discharged from the nozzle.

Moreover, as shown in FIG. 1, an ink receiving member 18 provided with a absorbing member such as sponge is arranged at a flushing position on an opposite side of the second suction cap 26 at the purge position, with respect to the paper transporting path R. At a predetermined timing during the use of the second head 2, or before and after the use of the second head 2, the carriage 9 is moved up to the flushing position, and in a state of the second head 2 brought face-to-face with the ink receiving member 18, it is possible to jet liquid droplets from the nozzles 16 of the second head 2 toward the ink receiving member 18 (flushing). The flushing is performed for preventing drying of ink in the nozzle when the ink is not jetted, and for preventing mixing of colors of inks in the nozzles 16*e* and 16*f* of two types after the suction purge of the second head 2.

Next, an electrical structure of the printer 200 with the control unit 8 as a center will be described below by referring to a block diagram in FIG. 14. The control unit 8 shown in FIG. 14 includes a central processing unit (CPU), a read only memory (ROM) in which various computer programs and data for controlling an overall operation of the printer 200 are stored, and a random access memory (RAM) which temporarily stores data etc. to be processed by the CPU. By executing the computer programs stored in the ROM, various controls described below may be performed. Or, it may be hardware in which various circuits including an arithmetic circuit are combined.

The control unit 8 includes a printing control section 80, a maintenance control section 81 (a maintenance control mechanism), and a cartridge detecting section 82. The printing control section 80 makes perform recording of an image etc. on a printing paper P by the first head 1 and the second head 2 by controlling the carriage drive motor 85 which drives and reciprocates the first head 1 which is a line head and the carriage 9, a paper transporting mechanism 86 which transports the printing paper P (concretely, a motor etc. which drives and rotates paper transporting rollers), based on data inputted from an input device 84 such as a personal computer (PC). More concretely, basic inks of four colors (namely, yellow, magenta, cyan, and black) are jetted from the first head 1 which is a line head, on to the printing paper P transported by the paper transporting mechanism 86. Furthermore, when printing of a highly defined image is sought, the inks of two colors (light cyan and light magenta) are jetted according to the requirement from the second nozzle 2 attached to the carriage 9 while moving the carriage 9 in the width direction of the printing paper P. Accordingly, image printing by inks of six colors namely the basic inks of four colors and the special inks of two colors becomes possible.

Moreover, the maintenance control section 81 makes perform the suction purge of the first head 1 and the second head 2 by controlling each component of the purge unit including the suction pump 19 etc. Furthermore, the maintenance control section 81 makes perform the flushing of the second head 2 according to the requirement with an object such as preventing drying of ink and preventing mixing of colors of inks after the suction purge.

The cartridge detecting section 82 detects upon distinguishing an attachment operation and a detachment operation of the ink cartridge 4 (or the dummy cartridge 70). Furthermore, the cartridge detecting section 82 detects upon distinguishing as to whether the ink cartridge 4 or the dummy cartridge 70 has been attached to the cartridge attachment portions 7*e* and 7*f* corresponding to the second head 2, based on a signal from the optical sensor 162. In other words, the cartridge detecting section 82 corresponds to a cartridge distinguishing section of the present invention.

Incidentally, as it has been described above, in the ink supply portion (a supply system which supplies the inks of two colors namely the light cyan and light magenta to the second head 2) which supplies the inks to the second head 2, by attaching the dummy cartridge 70 on the cartridge attachment portion 7, the communication with the atmosphere, of the ink supply portion is blocked, and it is possible to stop the supply of ink.

Accordingly, in a state that the ink cartridges 4 is attached to the two cartridge attachment portions 7*e* and 7*f* respectively corresponding to the second head 2 (in a state that the communication with the atmosphere, of the ink supply portion, is maintained), when the suction purge in which the second suction cap 26 and the suction pump 19 are used, the ink is sucked and discharged from the nozzles 16*e* and 16*f* of two types jetting the inks of two colors respectively, and the suction purge for the nozzles 16*e* and 16*f* of the two types is performed simultaneously (complete purge). Moreover, the ink cartridge 4 is attached to one of the two cartridge attachment portions 7, and in a state of the dummy cartridge 70 being attached to the other cartridge attachment portion 7, the ink is not discharged from the nozzles 16 corresponding to the other cartridge attachment portion 7 on which the dummy cartridge 70 has been attached, and the suction purge is performed only for the nozzles 16 corresponding to the one cartridge attachment portion 7 (partial purge).

In other words, the complete purge is possible as the suction pump 19 communicates in common with the nozzles 16 of two types via the second suction cap 26, and moreover, by blocking the communication with the atmosphere of a specific ink supply portion by the dummy cartridge 70, the partial purge for any one of the nozzles 16 becomes possible.

Particularly, in the printer 200 of the first embodiment, an arrangement is made such that, the basic inks having the high frequency of use are jetted from the first head 1 which is a line head, whereas, the inks having the low frequency of use (namely, colors of light cyan and light magenta) are jetted from the second head 2 which is a serial head. In this manner, since the inks jetted from the second head 2 have the low frequency of use, a necessity to purge the nozzles 16 jetting the inks which are hardly used every time simultaneously with the other nozzles 16 is low (in other words, it is not necessary to eliminate jetting defect when the nozzles 16 are hardly used). In such a case, it is particularly effective to perform the purge only for the nozzles 16 of special types for which the purge is really necessary, out of the nozzles 16*e* and 16*f* of two types jetting the inks of different colors respectively.

However, in a case, in which both of the two ink supply portions supplying the inks of two colors respectively communicate with the atmosphere (complete purge), and in a case, in which the communication with the atmosphere of one ink supply portion is blocked (partial purge), since the number of nozzles through which the ink is discharged practically is different, in the complete purge and the partial purge, a flow velocity of the ink and an amount of ink discharged from each nozzle 16 differ.

In other words, in the partial purge in which the number of nozzles through which the ink is discharged practically, the flow speed of the ink discharged from one nozzle 16 tends to be excessively high, the amount of ink discharged also tends to be large as compared to the complete purge. Therefore, when conditions for the suction purge such as an amount to be sucked and a suction force (a degree of a negative pressure) of the suction pump 19 are set to match with the complete purge, at the time of the partial purge, there is a possibility that the flow velocity of ink and the amount of ink discharged are more than necessary. Conversely, when the conditions for the suction purge are set to match with the partial purge, at the time of the complete purge, the flow speed of ink is excessively low, or the amount of ink discharged is insufficient, and there is a possibility that there is a nozzle for which the discharge of the thickened ink or the impurities and the air bubble is insufficient.

Therefore, in the first embodiment, the maintenance control section 81, at the time of the complete purge and at the time of the partial purge, controls the suction pump 19 such that a difference in the flow velocity of the ink and the amount of ink discharge becomes small for the nozzles 16. Concretely, first of all, the cartridge detecting section 82, based on the signal from the optical sensor 162, detects whether the dummy cartridge 70 has been attached to each of the two cartridge attachment portions 7. From a detection result, the maintenance control section 81, before performing the suction purge, finds whether the communication with the atmosphere for each of the two ink supply portions corresponding to the second head 2 has been blocked, and when the suction purge is performed, makes a judgment whether it is the complete purge or the partial purge.

After making the judgment, the maintenance control section 81, in the complete purge, increases the suction force (negative pressure) by increasing a rotational speed of the suction pump 19, than in the partial purge, to increase the flow velocity of ink from each nozzle 16 to be not less than a predetermined flow velocity. Moreover, the maintenance control section 81 sets the total number of rotations of the suction pump 19 during one purge to be on a higher side such that an amount of ink not less that the predetermined amount is discharged from each nozzle 16. Whereas, in the partial purge, the maintenance control section 81 sets the rotational speed and the total number of rotations of the suction pump 19 on a lower side than in the complete purge, such that no excessive ink is discharged from each nozzle 16. In this manner, at the time of the complete purge and at the time of the partial purge, by making small the difference in the flow velocity of the ink and the amount of ink discharged from each nozzle 16, it is possible to perform sufficient purge from any nozzle 16 at the time of the complete purge, and to prevent the excessive amount of ink more than necessary from being discharged from each nozzle 16 at the time of the partial purge.

As it has been described above, after the suction purge from the second head 2 is performed, sometimes the ink discharged from a certain nozzle 16 into the second suction cap 26 adheres to another nozzle 16 jetting the ink. Therefore, for preventing the mixing of colors between the nozzles 16 (mixing of ink of different type), it is preferable to perform flushing from the nozzle 16 upon moving the second head 2 up to the flushing position at which the ink receiving member 18 is arranged, after the suction purge. Here, the two types of inks are discharged simultaneously to the second suction cap 26 at the time of the complete purge, whereas, only one type of ink is discharged to the second suction cap 26 at the time of the partial purge. Therefore, the mixing of colors hardly occurs as compared to the case of the complete purge. Therefore, the maintenance control section 81, when the partial purge is performed, controls the second head 2 to decrease the amount of ink flushed from each nozzle 16 in the flushing immediate after the purge, as compared to the case in which the complete purge is performed. Accordingly, it is possible to reduce the amount of ink consumed at the time of flushing.

Next, a second embodiment of the present invention will be described below. In the second embodiment, a structure of the blocking mechanism which blocks the communication, with the atmosphere, of the two ink supply portions which supply the inks of two colors to the second head 2 is different from the structure of the blocking mechanism in the first embodiment. In the second embodiment to be described below, same reference numerals are assigned to components having almost same structure as in the first embodiment, and description of such components is omitted appropriately.

In the first embodiment, the communication with the atmosphere, of the ink supply portion including the cartridge attachment portion 7 is blocked by the dummy cartridge 70 being attached to that cartridge attachment portion 7 corresponding to the second head 2 (refer to FIG. 2). Whereas, in the second embodiment to be described below, upon having an arrangement made such that only the ink cartridge 4 which stores the ink is attached to a cartridge attachment portion 7A, the communication between the ink cartridge 4 attached to the cartridge attachment portion 7A and the atmosphere is blocked independently by the blocking mechanism. In the cartridge attachment portion 7A corresponding to the first head 1, similarly as in the first embodiment, as it is not necessary to block the communication with the atmosphere, of the ink supply portion for using a part of the ink, the mechanism for blocking the communication with the atmosphere as described above has not been provided.

Figure 15A:
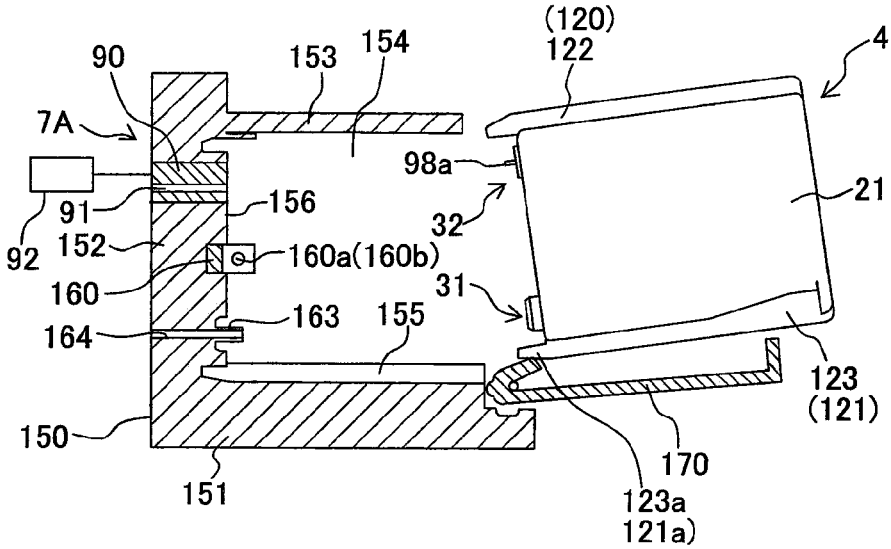
FIG. 15A, FIG. 15B, and FIG. 15C are diagrams explaining an operation of attaching an ink cartridge of a second embodiment, where.
Figure 15B:
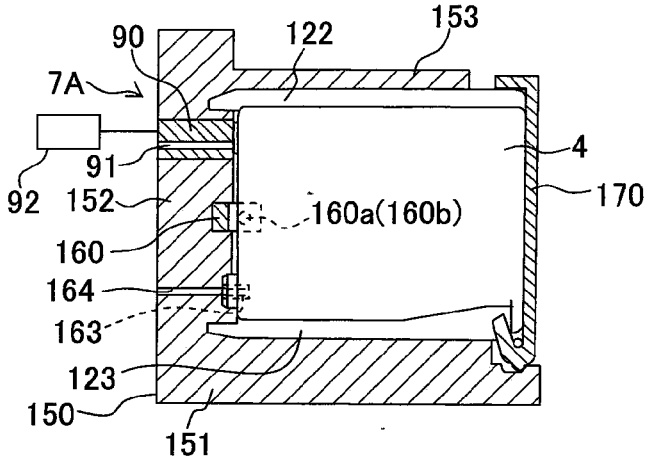
Figure 15C:
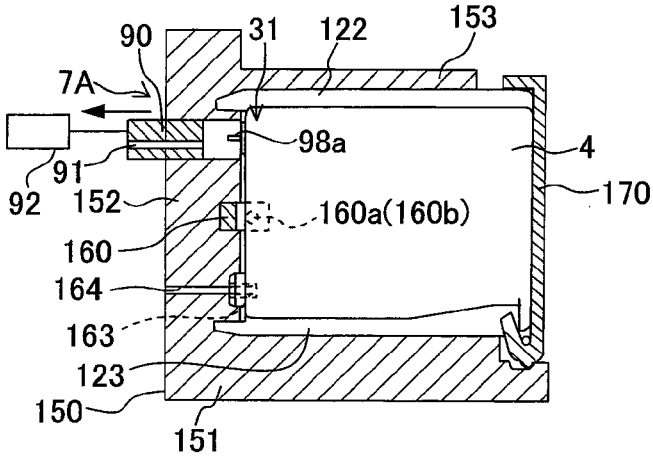

As shown in FIG. 15A, FIG. 15B, and FIG. 15C, at an inner wall portion of the cartridge attachment portion 7A, an opening and closing member 90 for operating an opening and closing valve (omitted in the diagram) in the atmosphere infusing portion 32 (atmosphere communicating portion) of the ink cartridge 4 is provided to be movable with respect to the frontward and rearward direction (left-right direction in FIG. 15A, FIG. 15B, and FIG. 15C). Moreover, a through hole 91 is formed in the opening and closing member 90 such that, the opening and closing member 90 is pierced through in the frontward and rearward direction. The through hole 91 is formed at a position not interfering with the pin 98*a* which protrudes from the atmosphere infusing portion 32 of the ink cartridge 4, and when the front end surface of the ink cartridge 4 has made a contact with the attachment surface 156, the pin 98*a* is not pierced through the through hole 91.

Figure 16:
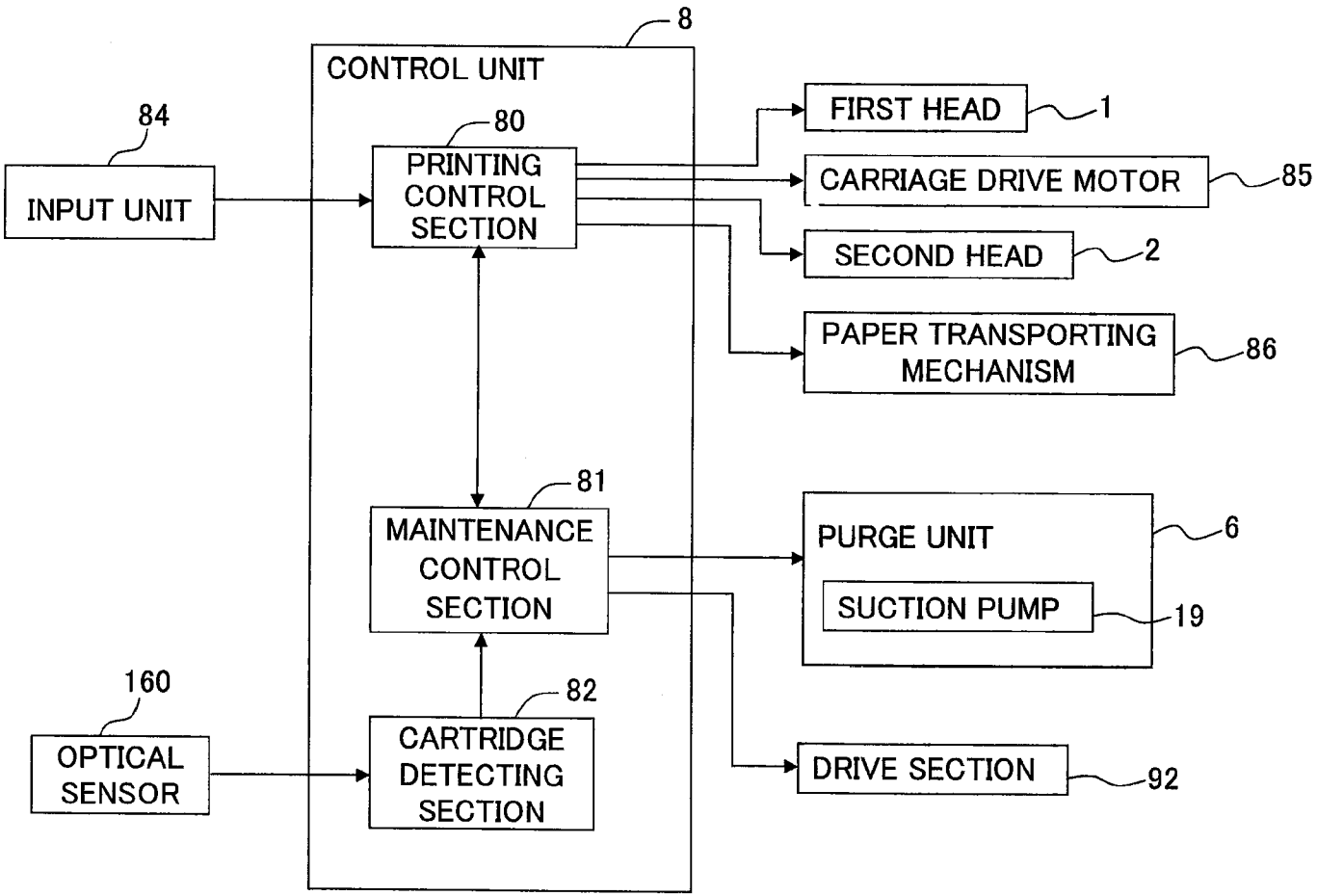
FIG. 16 is a block diagram showing schematically an electrical structure of a printer according to the second embodiment.

A drive section 92 including an appropriate drive mechanism such as a motor and a cylinder is linked to the opening and closing member 91. As shown in FIG. 16, a signal is output to the drive section 92 from the maintenance control section 81 of the control unit 8, and the drive section 92, upon receiving the signal, drives the opening and closing member 90 in the frontward and rearward direction.

As shown in FIG. 15A, at the time of attaching the ink cartridge 4, in a state of the lid member 170 opened, the ink cartridge 4 is inserted into the cartridge accommodating chamber 154 inside the cartridge attachment portion 7A, and the front end surface of the ink cartridge 4 makes a contact with the attachment surface 156 of the cartridge attachment portion 7A.

Here, as shown in FIG. 15B, when the opening and closing member 90 provided at the inner wall portion of the cartridge attachment portion 7A is at a position moved rearward (rightward in FIG. 15B), and when a rear end surface of the opening and closing member 90 and the attachment surface 156 are almost on the same plane, the pin 98*a* protruding from the atmosphere infusing portion 32 of the ink cartridge 4 is pushed upon making a contact with the rear end surface of the opening and closing member 90. At this time, the opening and closing valve inside the atmosphere infusing portion 32 is operated, thereby opening the atmosphere infusing channel, and communicates with the atmosphere via the through hole 91 in the opening and closing member 90. In other words, the space (the ink storage chamber 40) inside the ink cartridge 4 communicates with the atmosphere.

On the other hand, as shown in FIG. 15C, when the opening and closing member 90 is at a position moved frontward (leftward in FIG. 15C), and when the rear end surface of the opening and closing member 90 is in a position shifted forward than the attachment surface 156, the pin 98*a* of the ink cartridge 4 does not make a contact with the rear end surface of the opening and closing member 90, and the atmosphere infusing channel inside the atmosphere infusing portion 32 is not opened. Consequently, even when the ink cartridge 4 is attached to the cartridge attachment portion 7A, the internal space (the ink storage chamber 40) thereof does not communicate with the atmosphere.

In other words, in the second embodiment, by outputting a signal to the drive section 92 of the maintenance control section 81 of the control unit 8, and moving the opening and closing member 90 of each of the two cartridge attachment portions 7A in a frontward direction, it is possible to block independently the communication with the atmosphere, of the two ink cartridges 4 (4*e*, 4*f*) attached to the two cartridge attachment portions 7A respectively (in other words, the communication with the atmosphere, of the two ink supply portions from the two ink cartridges 4*e* and 4*f* up to the second head 2). In other words, the opening and closing member 90 and the drive section 92 which moves the opening and closing member 90 frontward and rearward corresponds to the blocking mechanism of the present invention, and particularly, the opening and closing member 90 corresponds to an opening and closing mechanism of the present invention.

In this manner, since it is possible to block independently the communication with the atmosphere, of the two ink supply portions which supply the inks of two colors, by the signal from the control unit 8 (the maintenance control section 81), when there is an ink which is not used at the time of printing out of the inks of two colors, it is possible to block the communication with the atmosphere, for the ink cartridge 4 which stores that ink.

Moreover, at the time of performing the suction purge, in a case, in which the suction purge is necessary for both the nozzles 16*e* and 16*f* of two types jetting the inks of two colors respectively, by making both the ink cartridges 4 communicate with the atmosphere, the suction purge (complete purge) of both the nozzles 16*e* and 16*f* of the two types is possible by one suction operation by the suction pump 19. On the other hand, at the time of performing the suction purge only for the nozzle 16 of one type, by making an arrangement such that the ink is not discharged by blocking the communication with the atmosphere, of the ink cartridge 4 which stores the other inks, the suction purge (partial purge) only for that nozzle 16 upon selecting the nozzle 16 of one type becomes possible. Moreover, similarly as in the first embodiment, by the maintenance control section 81 controlling the suction pump 19 such that the difference in the flow velocity of the ink and the amount discharged of ink from the nozzle 16 becomes small at the time of the complete purge and the partial purge, it is possible to perform the sufficient purge for any nozzle 16 at the time of the complete purge, and it is possible to prevent the excessive amount of ink being discharged from the nozzle 16 at the time of partial purge.

As it has been described above, in the second embodiment, as it is possible to switch the state of communication with the atmosphere, of the ink cartridge 4 by operating the opening and closing member 90 by a command from the maintenance control section 81, it is possible to realize one of the complete purge and the partial purge upon selecting appropriately according to the situation.

For instance, in a normal ink-jet printer, in many of the cases, an arrangement is made such that, immediately after a power supply is put ON, when a predetermined period of time has elapsed after the completion of the previous printing operation, a periodic purge (hereinafter, called as a "normal purge") is performed for all the nozzles. Therefore, the maintenance control section 81, at the time of performing the normal purge which is set to be performed at a predetermined timing, for the two cartridge attachment portions 7A corresponding to the second head 2, the complete purge is performed upon moving the opening and closing member 90 to a position (position in FIG. 15B) of opening the atmosphere communicating channel of the atmosphere infusing portion 32 of the ink cartridge 4.

On the other hand, in a case such as when the jetting performance of the nozzles 16 of one type is deteriorated, or when is predicted to be deteriorated, sometimes it is preferable to select a special purge in which the suction purge is performed only for the nozzles 16 for which the purge is necessary, and not to perform the suction purge from both the nozzles 16 of the two types. In a case of performing such special purge, the maintenance control section 81, for the cartridge attachment portion 7A corresponding to the nozzles 16 other than the nozzles 16 of a certain specific type, makes perform the partial purge for the nozzles 16 of the specific type, upon moving the opening and closing member 90 to a position (position in FIG. 15C) of not opening the atmosphere communicating channel of the atmosphere infusing portion 32 of the ink cartridge 4. Accordingly, the ink is not discharged wastefully from the other nozzles 16 for which it is not necessary to perform the purge.

The following are examples of the special purge. For instance, when the cartridge 4 in the cartridge attachment portion 7A is exchanged, an air bubble is susceptible to enter from the ink extracting tube 163 which is a portion connecting with cartridge attachment portion 7A in which the replacement is performed. Therefore, it is preferable to perform the purge for the nozzles 16 of the special type, communicating with the cartridge attachment portion 7A.

Here, as it has been described also in the first embodiment, since the cartridge detecting section 82 shown in a block diagram in FIG. 16 is capable of detecting upon distinguishing the attachment and detachment of the ink cartridge 4 based on the output signal from the optical sensor 160, it is possible to identify exchange of the ink cartridge 4. In other words, the cartridge detecting section 82 serves as both a cartridge attachment detecting mechanism which detects whether or not the ink cartridge 4 has been attached to the cartridge attachment portion 7A, and a cartridge exchange judging section which makes a judgment of whether or not the ink cartridge 4 has been exchanged.

The cartridge detecting section 82, based on the output signal from the optical sensor 160 of one cartridge attachment portion 7A, outputs to the maintenance control section 81, a signal which instructs to perform the suction purge for the nozzles 16 communicating with the one cartridge attachment portion 7A when a judgment is made that the ink cartridge 4 in that cartridge attachment portion 7A has been replaced. Upon receiving this signal, the maintenance control section 81 makes the purge unit 6 perform the suction purge upon blocking the communication with the atmosphere by moving the opening and closing member 90 of the other cartridge attachment portion 7A to a position in FIG. 15C. Accordingly, the suction purge is performed only for the nozzles 16 communicating with the one cartridge attachment portion 7A for which the ink cartridge 4 has been exchanged, and the suction purge is not performed for the nozzles 16 communicating with the other cartridge attachment portion 7A for which the ink cartridge 4 has not been replaced.

Moreover, in a case such as when an instruction is made by the user, when a signal instructing the type of the nozzle 16 for which the suction purge is to be performed is input from the external input unit 84 (in other words, when the type of the nozzles 16 for which the purge is to be performed is instructed), the maintenance control section 81 may perform the partial purge for those nozzles 16. In this case, the suction purge is not performed for the nozzles 16 for which there is no instruction.

The embodiments (the first embodiment and the second embodiment) of the present invention have been described above. However, the range of application of the present invention is not restricted to the embodiments described above, and the following modifications which fall within the scope of the present invention are possible.

The printer of the embodiments described above includes the first head 1 which is a line head and the second head 2 which is a serial head, and carries out the suction purge by blocking the communication with the atmosphere, of the ink supply portion corresponding to the second head 2 jetting the inks having the low frequency of use. However, an arrangement of blocking the communication with the atmosphere may be provided to the ink supply portion corresponding to the first head 1 of a serial type, and the partial purge may be possible for the first head 1.

In the embodiments described above, the ink having the low frequency of use is jetted from the second head 2 which is a serial head. However, the ink having the low frequency of use may be jetted from the first head 1 which is a line head. In this case, it is preferable to make it possible to perform the partial purge for each of the nozzles of the plurality of types, of the first head 1 upon making an arrangement such that it is possible to block the communication with the atmosphere of each of the plurality of ink supply portions corresponding to the first head 1.

As an ink having the low frequency of use, apart from the inks of the light cyan color and the light magenta color, special-colored inks such as golden-colored ink, silver-colored ink, flesh-colored ink, and fluorescent-colored ink may be used.

The present invention is not applicable only to a printer having two types of heads namely a line head and a serial head. The present invention is also applicable to a printer which includes only one of the line head and the serial head.

The section which detects whether an ink cartridge has been attached to a cartridge attachment portion is not restricted to an optical sensor. It is also possible to use other known sensors such as a sensor of an electrical contact type, which detects the attachment by a contact point on a side of the ink cartridge and a contact point on a side of the cartridge attachment portion making a contact.

The embodiments which have been described above are embodiments, in which the present invention is applied to the ink-jet printer 200 in which the inks are supplied to the first head 1 and the second head 2 from the ink cartridges 4*a* to 4*f* attached to the holder 5, via the tubes 10 and 11. However, the method of supplying the ink is not restricted to such method. For instance, in an ink-jet printer which includes only a head which jets inks while moving in a predetermined direction together with a carriage, such as the second head in the abovementioned embodiments, an attachment portion of an ink cartridge may be provided to the carriage, and the ink may be supplied directly to the head from the ink cartridge attached to the attachment portion of the carriage.

In the first embodiment, the detection of as to whether the cartridge attached to the cartridge attachment portion is an ink cartridge or a dummy cartridge has been made by detecting a difference in a shape of an external case. However, a method of detection is not restricted to such method. For instance, a detection of whether or not it is a dummy cartridge may be made by detecting whether or not a light shielding portion which shields light of a sensor has been provided or not, even when the shape of the external case is the same.

In the embodiments described above, the present invention is applied to an ink-jet printer which records an image etc. by jetting an ink onto a recording paper. However, the application of the present invention is not restricted to such application. In other words, the present invention is also applicable to various liquid droplet jetting apparatuses which jet liquids of various types other than ink, which are susceptible to thickening due to an entry of a gas or due to drying according to an application.

What is claimed is:

1. A liquid droplet jetting apparatus configured to jet liquid droplets of a liquid, comprising:

a liquid droplet jetting head having a plurality of nozzles from which liquid droplets of the liquid are jetted, the plurality of nozzles forming a plurality of nozzle groups;

a plurality of cartridge attachment portions which are configured to communicate with the plurality of nozzle groups via liquid supply channels respectively, and each of which is configured such that one of a liquid cartridge and a dummy cartridge is attachable at a time, the liquid cartridge having an atmosphere communicating portion and being configured to store the liquid to be supplied to one of a plurality of nozzle groups, and the dummy cartridge being configured to block a communication between each of the plurality of cartridge attachment portions and atmosphere by being attached thereto;

configured to cover all of the plurality of nozzles by being attached to the liquid droplet jetting head;

a suction mechanism configured to perform a suction purge by sucking inside the suction cap in a state that the suction cap is attached to the liquid droplet jetting head and the suction mechanism communicates in common with all of the plurality of nozzles via the suction cap;

a cartridge identifying section configured to identify a first state in which the liquid cartridge is attached and a second state in which the dummy cartridge is attached, with respect to each of the plurality of cartridge attachment portions; and a maintenance control section configured to control the suction mechanism based on an identifying result of the cartridge identifying section;

wherein, in a case that the cartridge identifying section identifies that all of the plurality of cartridge attachment portions are in the first state, the maintenance control section is configured to control the suction mechanism to perform a complete purge, in which the suction purge is performed in a state that each of the plurality of cartridge attachment portions is communicated with atmosphere via the atmosphere communication portion of the liquid cartridge attached thereto, and in which the liquid is discharged from each of the plurality of nozzles;

wherein, in a case that a cartridge attachment portion in the first state and a cartridge attachment portion in the second state are identified by the cartridge identifying section, the maintenance control section is configured to control the suction mechanism to perform a partial purge, in which the suction purge is performed in a state that the cartridge attachment portion in the first state is communicated with atmosphere via the atmosphere communication portion of the liquid cartridge attached thereto and the cartridge attachment portion in the second state is not communicated with atmosphere, and in which the liquid is discharged from each nozzle in a nozzle group which is communicated with the cartridge attachment portion in the first state; and wherein, in the partial purge, the maintenance control section is configured to control the suction mechanism to decrease suction force as compared with the complete purge so that discharge amount and flow speed of the liquid discharged from each nozzle in the nozzle group, which is communicated with the cartridge attachment portion in the first state, come closer to discharge amount and flow speed of the liquid discharged from each of the plurality of nozzles in the complete purge.

2. The liquid droplet jetting apparatus according to claim 1;

wherein the maintenance control section is configured to further control the liquid droplet jetting head to perform a flushing immediately after the suction purge in addition to the suction purge; and when the partial purge is performed, the maintenance control section is configured to control the liquid droplet jetting head to reduce a flushing amount of each of the nozzles than that when the complete purge is performed.

3. The liquid droplet jetting apparatus according to claim 1;

wherein the liquid includes basic liquids and special liquids which are used less frequently than the basic liquids, the liquid droplet jetting head is a serial head which reciprocates in a predetermined scanning direction intersecting a transporting direction of an object while jetting, toward the object which is transported in the transporting direction, the special liquids from the plurality of types of nozzles; and wherein the liquid droplet jetting head further includes, in addition to the serial head, a line head having a plurality of nozzles which jets the basic liquids and which are arranged in a row along a direction intersecting with the transporting direction.

4. The liquid droplet jetting apparatus according to claim 1;

wherein, in the partial purge, the maintenance control section is configured to control the suction mechanism to decrease the suction force as the number of cartridge attachment portions in the second state identified by the cartridge identifying section is increased.

5. The liquid droplet jetting apparatus according to claim 1;

wherein the liquid includes a plurality of types of ink; and wherein the liquid cartridge is configured to store one of the plurality of types of ink to be supplied to one of the plurality of nozzle groups.

* * * * *

UNITED STATES PATENT AND TRADEMARK OFFICE

CERTIFICATE OF CORRECTION

PATENT NO. : 8,789,917 B2
APPLICATION NO. : 12/549550
DATED : July 29, 2014
INVENTOR(S) : Tomoyuki Kubo et al.

It is certified that error appears in the above-identified patent and that said Letters Patent is hereby corrected as shown below:

In the Claims

At column 25, claim number 1, line number 12 should read:

-- a suction cap configured to cover of all the plurality of nozzles by being attached to the liquid droplet jetting head; --

Signed and Sealed this
Twentieth Day of January, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,789,917 B2
APPLICATION NO. : 12/549550
DATED : July 29, 2014
INVENTOR(S) : Tomoyuki Kubo et al.

It is certified that error appears in the above-identified patent and that said Letters Patent is hereby corrected as shown below:

In the Claims

At column 25, claim number 1, line number 17 should read:

-- a suction cap configured to cover of all the plurality of nozzles by being attached to the liquid droplet jetting head; --

This certificate supersedes the Certificate of Correction issued January 20, 2015.

Signed and Sealed this
Ninth Day of June, 2015

Michelle K. Lee

Michelle K. Lee
*Director of the United States Patent and Trademark Office*